US007510300B2

(12) United States Patent
Iwauchi et al.

(10) Patent No.: US 7,510,300 B2
(45) Date of Patent: Mar. 31, 2009

(54) LIGHT EMITTING DEVICE AND DISPLAY APPARATUS AND READ APPARATUS USING THE LIGHT EMITTING DEVICE

(75) Inventors: Kenichi Iwauchi, Matsudo (JP); Atsushi Yamanaka, Chiba (JP); Mitsuyoshi Seo, Ichikawa (JP); Akemi Oohara, Funabashi (JP)

(73) Assignee: Sharp Kabushiki Kaisha, Osaka (JP)

( * ) Notice: Subject to any disclaimer, the term of this patent is extended or adjusted under 35 U.S.C. 154(b) by 9 days.

(21) Appl. No.: 10/506,061

(22) PCT Filed: Feb. 27, 2003

(86) PCT No.: PCT/JP03/02274

§ 371 (c)(1),
(2), (4) Date: Oct. 28, 2004

(87) PCT Pub. No.: WO03/075617

PCT Pub. Date: Dec. 9, 2003

(65) Prior Publication Data

US 2005/0117190 A1 Jun. 2, 2005

(30) Foreign Application Priority Data

Mar. 1, 2002 (JP) ..... 2002-055253
Jul. 19, 2002 (JP) ..... 2002-211175
Nov. 22, 2002 (JP) ..... 2002-340052

(51) Int. Cl.
*F21V 9/00* (2006.01)

(52) U.S. Cl. ..... 362/231; 362/613; 315/149; 315/312; 315/307

(58) Field of Classification Search ..... 362/276, 362/615, 552, 230–231, 802, 612, 613; 315/149, 315/157, 291, 307, 312, 185 R; 250/205
See application file for complete search history.

(56) References Cited

U.S. PATENT DOCUMENTS 4,514,727 A 4/1985 Van Antwerp
4,947,291 A * 8/1990 McDermott ..... 362/19
5,471,052 A 11/1995 Ryczek
5,803,579 A * 9/1998 Turnbull et al. ..... 362/516
6,127,783 A 10/2000 Pashley et al.
6,157,453 A * 12/2000 Tamanti et al. ..... 356/406

(Continued)

FOREIGN PATENT DOCUMENTS

EP 0185775 A1 7/1986

(Continued)

*Primary Examiner*—Thomas M Sember
(74) *Attorney, Agent, or Firm*—Birch, Stewart, Kolasch & Birch, LLP

(57) ABSTRACT

A light emitting device provided with a plurality of types of light sources having different light emitting colors and with a light emission control means for allowing light to emit, during a specified period of monitoring a light emitting intensity, from at least one light source out of the plurality of types of light sources at a light emitting intensity different from that available outside the specified period. Accordingly, when a plurality of types of light sources are used, the light emitting intensities of a plurality of types of light sources can be monitored with light sensors of types fewer than the types of light sources to control while points and a brightness characteristics.

13 Claims, 15 Drawing Sheets

U.S. PATENT DOCUMENTS

| | | | | |
|---|---|---|---|---|
| 6,753,661 | B2 * | 6/2004 | Muthu et al. | 315/307 |
| 7,183,718 | B2 * | 2/2007 | Yoshida | 315/153 |
| 7,186,000 | B2 * | 3/2007 | Lebens et al. | 362/184 |
| 7,186,003 | B2 * | 3/2007 | Dowling et al. | 362/234 |
| 2002/0047624 | A1 * | 4/2002 | Stam et al. | 315/291 |

FOREIGN PATENT DOCUMENTS

| | | | |
|---|---|---|---|
| EP | 1225557 | A1 | 7/2002 |
| JP | 4-196491 | A | 7/1992 |
| JP | 6-138459 | A | 5/1994 |
| JP | 8-30230 | A | 2/1996 |
| JP | 9-311317 | A | 12/1997 |
| JP | 10-49074 | A | 2/1998 |
| JP | 10-281873 | A | 10/1998 |
| JP | 11-185516 | A | 7/1999 |
| JP | 11-295689 | A | 10/1999 |
| JP | 2002-26383 | A | 1/2002 |
| WO | WO-86/00483 | A1 | 1/1986 |
| WO | WO-00/37904 | A1 | 6/2000 |
| WO | WO-01/26085 | A1 | 4/2001 |

* cited by examiner

LIGHT EMITTING DEVICE AND DISPLAY APPARATUS AND READ APPARATUS USING THE LIGHT EMITTING DEVICE

BACKGROUND OF THE INVENTION

1. Technical Field

The present invention relates to a light-emitting device comprising a light source which emits light having a plurality of colors, a display apparatus using the light-emitting device, and a read apparatus using the light-emitting device.

2. Description of the Related Art

It has been conventionally known that, in some types of transmissive liquid crystal which employ a backlight including a side light, and reflective liquid crystals which employ a front light, a light-emitting device, which includes a white cold cathode fluorescent tube or a white light-emitting diode (LED) as a light source, is mounted as a back light or a front light for display. Particularly, many types of cellular phones which have rapidly become popular recently-employ a white LED.

However, a light source using a white cold cathode fluorescent tube and a white LED have a problem that white point and luminance characteristics vary largely depending on changes in temperature characteristics and changes over time. In order to solve this problem, the following two methods have been proposed, for example.

The first method is effective in the case where multiple types of light sources emitting light of different colors are switched by a time-division to provide a white light source. As described in Japanese Laid-Open Publication No. 10-49074, for example, light sources of respective colors are monitored by an optical sensor and changes in amounts of light are fed back to respective light sources for emitting white light.

The second method is effective for the case where multiple types of light sources emitting light of different colors are made to emit light at the same time to provide a white light source. As described in Japanese Laid-Open Publication No. 11-295689, light sources of respective colors are monitored by an optical sensor and changes in amounts of light are fed back to respective light sources so as to have an equal value as a certain predetermined value for emitting white light.

General examples of light-emitting operations of light sources for allowing the multiple types of light sources to emit light at the same time and the colors of emitted light to be mixed for providing white color in the second method mentioned above are shown in FIGS. 12 and 13. The multiple types of the light sources are, for example, a red LED, a green LED, and a blue LED Methods for controlling a light-emitting operation of the light sources are roughly divided into two types: a pulse width control method shown in FIG. 12; and a current value control method shown in FIG. 13. A method which combines these two methods is also possible.

FIGS. 12(*a*), (*b*) and (*a*) are graphs which respectively show the performance of pulse width control of current values flowing through the red, green and blue light sources, with the horizontal axes indicating time and the vertical axes indicating current value. By performing pulse width control of the emission intensities of the light sources, i.e., by controlling the time lengths of the light emitted by the light sources while the emission intensities of the light sources are maintained constant, apparent light emission intensities change. For example, in order to increase the apparent light emission intensities, the light emitting time of the light sources is lengthened. In order to reduce the apparent emission Intensities, the light emitting time of the light sources is shortened. In this way, the apparent light intensities of the light sources are controlled by adjusting the length of time while light is emitted and the length of time while light is not emitted.

Taking the light-emitting operation of the red light source as shown in FIG. 12(*a*) as a standard, the green light source as shown in FIG. 12(*b*) emits light for a period of time shorter than that of the red light source in the first cycle. In the next cycle, the green light source emits the light for a further shorter time to reduce the apparent emission intensities. The blue light source as shown in FIG. 12(*c*) emits light for a period of time longer than the red light source. In the next cycle, the blue light source emits light for further longer time to increase the apparent emission intensities.

As described above, in the pulse width control method, the light-emitting time of the light sources are controlled at a predetermined frequency while the values of the current flowing through the light sources are maintained constant. The frequency should be set to a cycle which is not perceived by the eyes of a human, for example, 60 Hz or higher. If the frequency is set too high, the cost for the driving circuit increases. Thus, generally the frequency is set to about 200 Hz.

Similarly to FIG. 12. FIGS. 13(*a*), (*b*) and (*a*) are graphs which respectively show sequentially changing current values flowing through the red, green and blue light sources, with the horizontal axes indicating the time and the vertical axes indicating the current values. In this case, by sequentially changing the amount of the current flowing through the light sources over time, the emission intensities of the light sources is controlled. In order to increase the emission intensities, the current value is increased. In order to reduce the emission intensities, the current value is reduced. For example, in the red light source as shown in FIG. 13(*a*), the emission intensity is increased by increasing the current values flowing through the red light source. In the green light source as shown in FIG. 13(*b*), the emission intensity is reduced by reducing the current values. As shown in FIG. 13(*c*), the emission intensity may be maintained constant by allowing a current which is constant in terms of time to flow.

The first and the second methods described above have the following problems. First, the time-division switching method described in Japanese Laid-Open Publication No. 10-49074 has an advantage that the emission intensities of the light sources can be monitored by a single type optical sensor, but the method has a critical problem that it is effective for only the time-division method, in which light sources are turned on one type at a time in turn, and it cannot be applied to a method other than the time-division method.

Further, the simultaneous light-emitting method described in Japanese Laid-Open Publication No. 11-295689 has a problem that the cost is high because a color separation filter is necessary in addition to three types of optical sensor corresponding to the red, green, and blue light sources, and a problem that control of the emission intensities becomes inaccurate due to a variance in optical sensor outputs because three types of optical sensor cannot be located at the same place.

Further, although it is desirable that the backlight emits light uniformly across its entire surface, it is difficult to actually emit light in a uniform manner. Thus, uneven luminance is usually generated. It is also a concern that, when three types of the light sources, i.e., a red light source, a green light source, and a blue light source are used instead of a light source emitting white light, uneven color may be generated because the colors of the light from the light sources are not perfectly mixed. In the case where such uneven luminance or uneven color is generated, variance may be a problem depending on where the display apparatus is located.

DISCLOSURE OF THE INVENTION

The present invention has been proposed in view of various problems as described above. The objective of the present invention is to provide a light-emitting device which can monitor emission intensities of multiple types of the light sources with fewer types of optical sensors, and can control white point and/or luminance properties, and a display apparatus and a read apparatus using the light-emitting device.

In order to achieve the above described objective, the present invention provides a light emitting device comprising: multiple types of light sources emitting light of different colors; a light detection means for monitoring emission intensity of at least one light source among the multiple types of light sources; and a light emission control means which performs control to provide a light emitting period in which all of the multiple types of the light sources emit light at the same time at predetermined emission intensities and a monitoring period in which at least one of the multiple types of the light sources emits light at an emission intensity different from that in the light emitting period in which all of the multiple types of the light sources emit light at the same time, wherein the light emission control means controls the emission intensity of the at least one light source among the multiple types of the light sources based on emission intensity information from the light detection means in the monitoring period to adjust composite light from the multiple types of the light sources to have a desired luminance or chromaticity.

Preferably, in the present invention the light emission control means is characterized by turning off at least one light source among the multiple types of the light sources in the monitoring period.

Preferably, in the present invention the light emission control means is characterized by shifting either timing to turn on each light source or timing to turn off each light source.

Preferably, in the present invention the light emission control means is characterized by decreasing the emission intensity of at least one light source among the multiple types of the light sources in the monitoring period.

Preferably, in the present invention the light emission control means is characterized by shifting either timing to make the emission intensity of each light source to the predetermined emission intensity or timing to decrease the emission intensity.

Preferably, in the present invention the light emission control means is characterized by increasing the emission intensity of at least one light source among the multiple types of the light sources in the monitoring period.

Preferably, in the present invention the light emission control means is characterized by shifting either timing to make the emission intensity of each light source to the predetermined emission intensity or timing to increase the emission intensity.

Preferably, in the present invention, the light detection means is characterized by having spectral sensitivity characteristics approximately matching luminosity factor characteristics with the light emission wavelength of the at least one light source among the multiple types of light sources.

Preferably, in the present invention, the light detection means is characterized by comprising a luminosity factor filter for blocking infrared radiation.

Preferably, the present invention is characterized in that a period in which all of the multiple types of the light sources are turned off is provided, and the Light detection means monitor amount of light in a state that all of the multiple types of the light sources are turned off.

Preferably, the present invention is characterized by comprising: a light source unit including a plurality of three types of light sources; a light guide plate for uniformly irradiating a plane with light from the light source unit; and an optical sensor as a light detection means provided in the vicinity of the light guide plate.

Preferably, the present invention is characterized by comprising: a first light source unit including a plurality of one or two types. of light sources; a first light guide plate for uniformly irradiating a plane with light from the first light source unit; a second light source unit including one or two type of light sources different from the above light sources; a second light guide plate for uniformly irradiating a plane with light from the second light source unit and the first light guide plate; and an optical sensor as a light detection means provided in the vicinity of the first and the second light guide plates.

Preferably, the present invention provides a display apparatus using a light emitting device as described above.

Preferably, the present invention provides a display apparatus using a light emitting device described above, wherein: when a level of a luminance signal included in an input video signal is equal to or less than the threshold value, the monitoring period is started.

Preferably, the present invention provides a display apparatus using a light emitting device described above, wherein: in the period in which each light source is turned off, a size of a drive signal of the display apparatus is extended.

Preferably, the present invention provides a display apparatus using a light emitting device described above, wherein: when a level of a luminance signal included in an input video signal is equal to or less than the threshold value, the period in which the emission intensity of each light source is decreased is started.

Preferably, the present invention provides a display apparatus using a light emitting device described above, wherein: in the period in which the emission intensity of each light source is decreased, a size of a drive signal of the display apparatus is extended.

Preferably, the present invention provides a read apparatus using a light emitting device described above.

BRIEF DESCRIPTION OF THE DRAWINGS

FIG. 7(*d*) is a diagram illustrating a light emitting operation of the entire, light source in accordance with the above operations.

FIG. 8(*a*) is a diagram illustrating a light emitting operation of the entire light source in accordance with the above operations.

FIG. 9(*d*) is a diagram illustrating a light emitting operation of the entire light source in accordance with the above operations.

FIG. 11(*b*) is a diagram schematically showing a light emitting device used for the, read apparatus.

DETAILED DESCRIPTION OF THE INVENTION

Hereinafter, the first through fourth embodiments of the present invention will be described with reference to the drawings.

First Driving Example of First Embodiment

Figure 1:
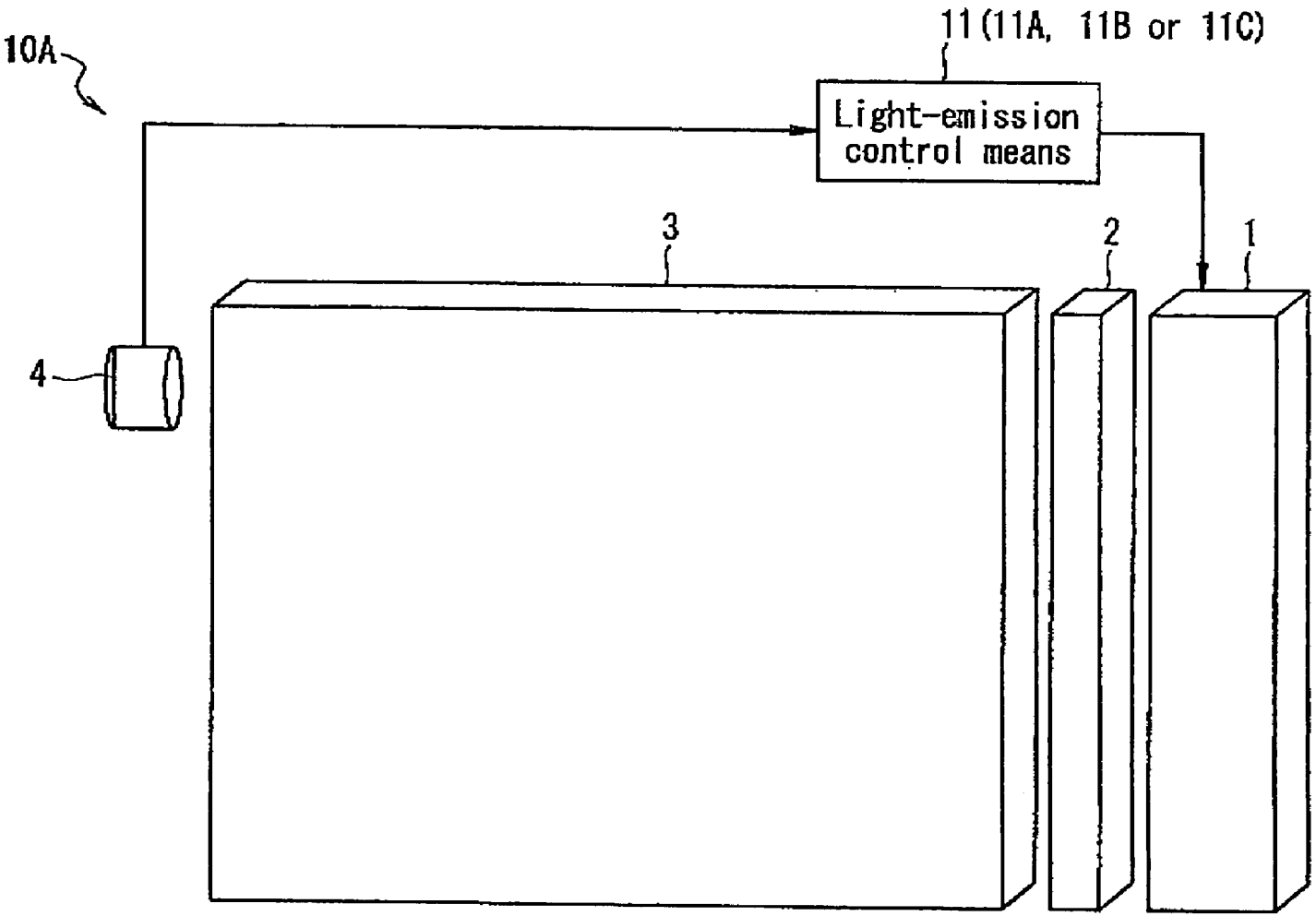
FIG. 1 is a diagram schematically showing a first embodiment of a light emitting device according to the present invention.

FIG. 1 schematically shows the first embodiment of the light emitting device according to the present invention a In the first embodiment, as the basic components, the light emitting device 10A includes: the light source unit 1 in which three types of light sources emitting light of different colors are located; a color mixing part 2 which allows three different types of light generated from the light source unit 1 to be recognized as white color without color unevenness; a light guide plate 3 for guiding the white light mixed in the color mixing part 2 to an entire panel of the display-apparatus (FIG. 2); an optical sensor 4 as a light detection means for monitoring the intensity of light transmitted through the light guide plate 3; and light-emission control means 11 which receives emission intensity information of the light sources obtained by performing light emission control of the emission intensities of the three types of the light sources for monitoring during a monitoring period as monitoring results from the optical sensor 4, and performs light emission control of the three types of the light sources so as to have a predetermined emission intensity based on the emission intensity information.

Figure 2:
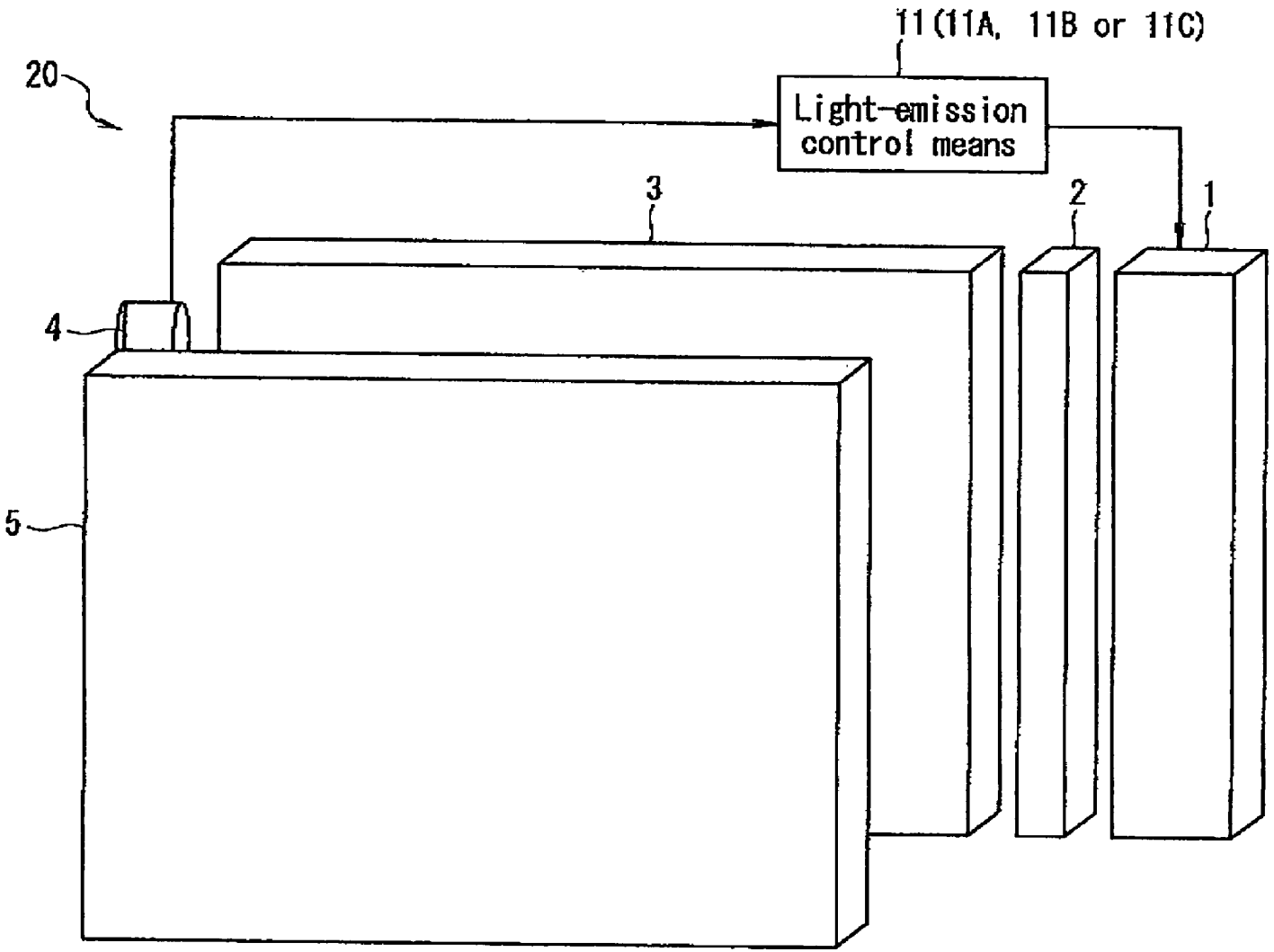
FIG. 2 is a schematic diagram of a liquid crystal display apparatus using the light emitting device of FIG. 1 as an auxiliary light source.

FIG. 2 shows a liquid crystal display apparatus 20 which uses the light-emitting device 10A shown in FIG. 1 as a backlight or a front light. A liquid crystal panel 5 is located in front of (or behind) the light guide plate 3. In other words, in the case where the liquid crystal panel 5 is of a transmissive type, the liquid crystal panel 5 is located in front of the light guide plate 3, i.e., on the side of the user. In the case where the liquid crystal panel 5 is of a reflective type, the liquid crystal panel 5 is located behind the light guide plate 3, although this case is not illustrated;

Although the components are Illustrated to be separate from each other in FIGS. 1 and 2 for facilitating understanding, it is desirable to position the components close to each other. Further, in FIG. 1, the differences in the size of the components are emphasized for facilitating understanding, and the actual sizes of the components are different to those illustrated.

In the light emitting device 10A shown in FIGS. 1 and 2, LEDs having three primary colors of light, i.e., red, green and blue are placed in the light source unit 1. Light passes through the light mixing part 2 and mixing is performed to obtain white light. The white light passes through the light guide plate 3 and is received by the optical sensor 4. The optical sensor 4 produces a detection output corresponding to the sum of the intensities of light from LEDs which have emitted light. Usually, when red, green and is blue LEDs are turned on at the same time, white light is generated from an appropriate emission ratio of the LEDs. Since temperature characteristics in light emission efficiency due the heat generated by the LEDs varies depending on color, the white color balance of white collapses and the white point is shifted greatly. Further, a shift in the white point due to change over time may also be generated, Accordingly, in the light-emission control means 11 of the present invention, a short monitoring period is intermittently provided while the red, green and blue LEDS in the light source unit 1 operate at the same time and white light is emitted. During such a monitoring period, one or two LEDs are independently turned on at different times in turn, and the rest of the LEDs are turned off. For example, during a monitoring period, the red, green and blue LEDs are pulse-driven in turn by a pulse frequency of 200 Hz, for example.

Figure 3:
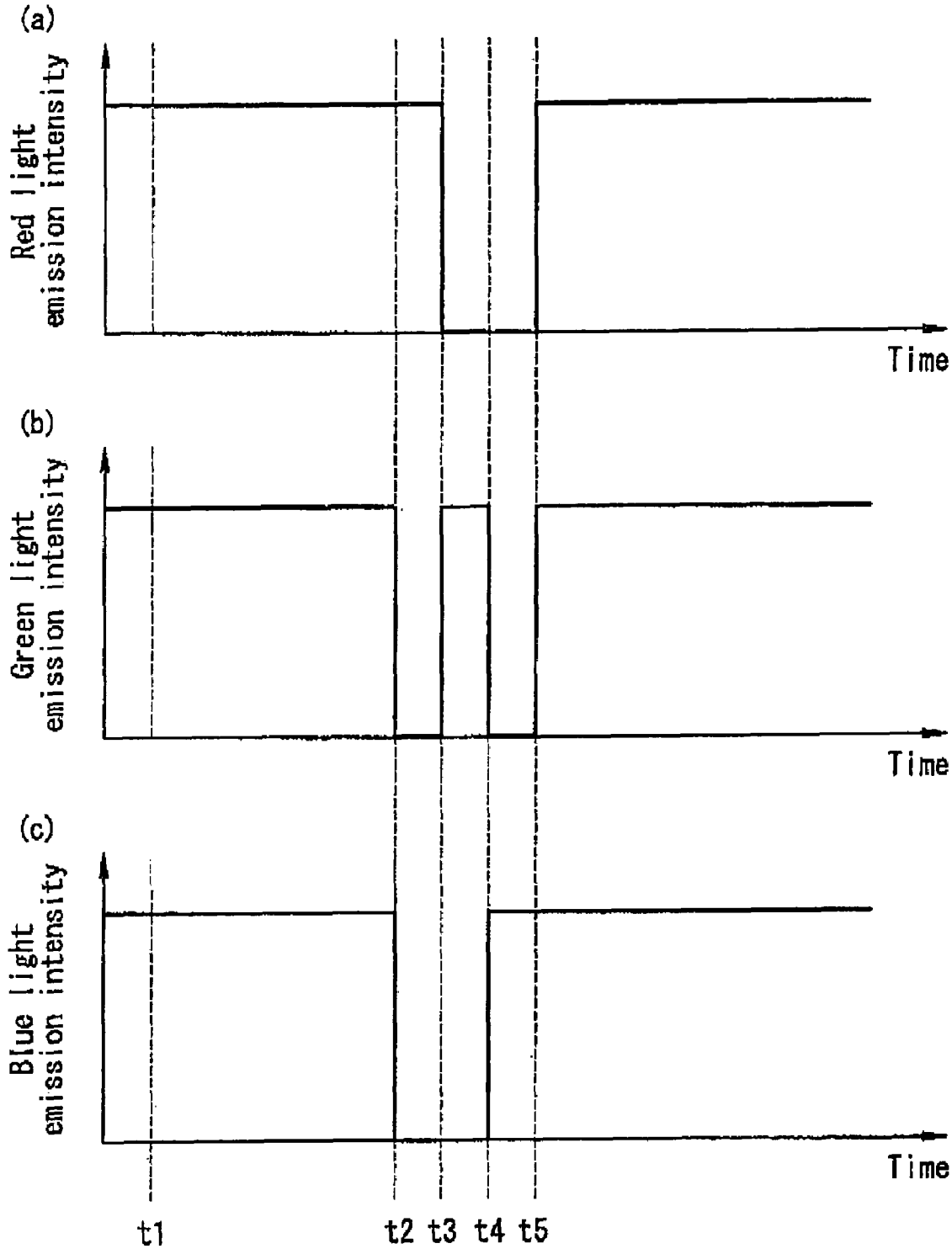
FIG. 3 is a schematic diagram showing a first driving example of the light emitting device of FIG. 1 during a monitoring period.

For example, it is assumed that, during the monitoring period, the red, green and blue LEDs are driven such that they emit light one type at a time in this order and such that, while one LED is turned on, the other two types of LEDs are turned off the time during which the two types of light sources are turned off is 1/200 second, which is 1 cycle of a frequency for pulse-driving a LED. In the case that three types of LEDs are turned on in turn, the monitoring period is just 3/200 seconds. Such an operation is performed by light-emission control means ALA, which is one example of the light-emission control means 11, and is shown in FIG. 3. In FIG. 3, (a) indicates the emission intensity of the red LED, (b) indicates the emission intensity of the green LED, and (c) indicates the emission intensity of the blue LED. The vertical axes indicate emission intensity and the horizontal axes indicate time.

In FIG. 3(*a*)-(*c*), during a period from time t1 to t2, all the red, green and blue LEDs are turned on. Thus, the light-emitting device 10A emits white light. Then, a monitoring period starts at time t2. Only the red LED emits light and the green and blue LEDs are turned off. Thus, the light emitting device 10A emits red color light. After 1/200 second has elapsed from time t2 it becomes time t3, and the green LED is turned on, the red LED is turned off, and the blue LED remains in the turned off state. After another 1/200 second has elapsed it becomes time t4, and the blue LED is turned on, the green LED is turned off, and the red LED remains in the turned off state. Then, after another 1/200 second has elapsed it becomes time t5, and the monitoring period ends. Three types of LEDs are all turned on and the light emitting device 10A provides white light.

The emission intensities of the LEDs in the light source unit 1 are monitored by optical sensor 4 only during the monitoring period t2-t5. In this case, the red, green and blue LEDs are separately monitored. Thus, the light emitting properties of the LEDs can be obtained without performing a special operation. Thus-obtained emission intensities of the red, green and blue LEDs are compared with the reference value. The results are fed back to the LEDs to adjust the emission intensities such that the difference therebetween becomes zero. Thus, the light emitting device 10A can be stable at any white point. As a result of such an adjustment, the emission intensity of the LEDs at or before time t2 and the emission intensity at or after time t5 are different in the strict sense since they are the values before and after the LEDs receive feedback.

During the monitoring period t2-t5, the intensity of light entering the eyes is ⅓ of normal. However, since the monitoring period is extremely short, for example, 3/200 seconds, the extinction of the light emitting device 10A caused by turning off two LEDs can be said to be at a level which is not annoying.

A frequency to monitor the light-emitting property of the LEDs may be, for example, once in one minute. In other words, monitoring periods maybe set to have about a one-minute interval. However, in the case where the light-emitting property of any of the LEDs changes greatly, the LEDs should be monitored in shorter intervals. On the contrary, while the light-emitting properties of the LEDs indicate a small change, monitoring may be performed in longer intervals.

Second Driving Example of First Embodiment

In FIG. 3 showing the first driving example of the first embodiment, three types of LEDs are turned on one by one in turn by the light-emission control means 11A during a monitoring period, and, while one type of LED is turned on, the other two types of LEDs are turned off. Thus, there is extinction caused by turning off the two types of LEDs during a monitoring period, i.e. a decrease in an amount of light emitted from the light source unit 1, although it is a short period of time. One of the monitoring methods which avoids an influence of such extinction is the second driving example of the first embodiment. In this driving example, light-emission control means 11B, which is another example of the light-emission control means 11, turns on two of the three types of LEDs in turn at a time during the monitoring period and, while the two types of LEDs are turned on, the remaining one type of LED is turned off.

Figure 4:
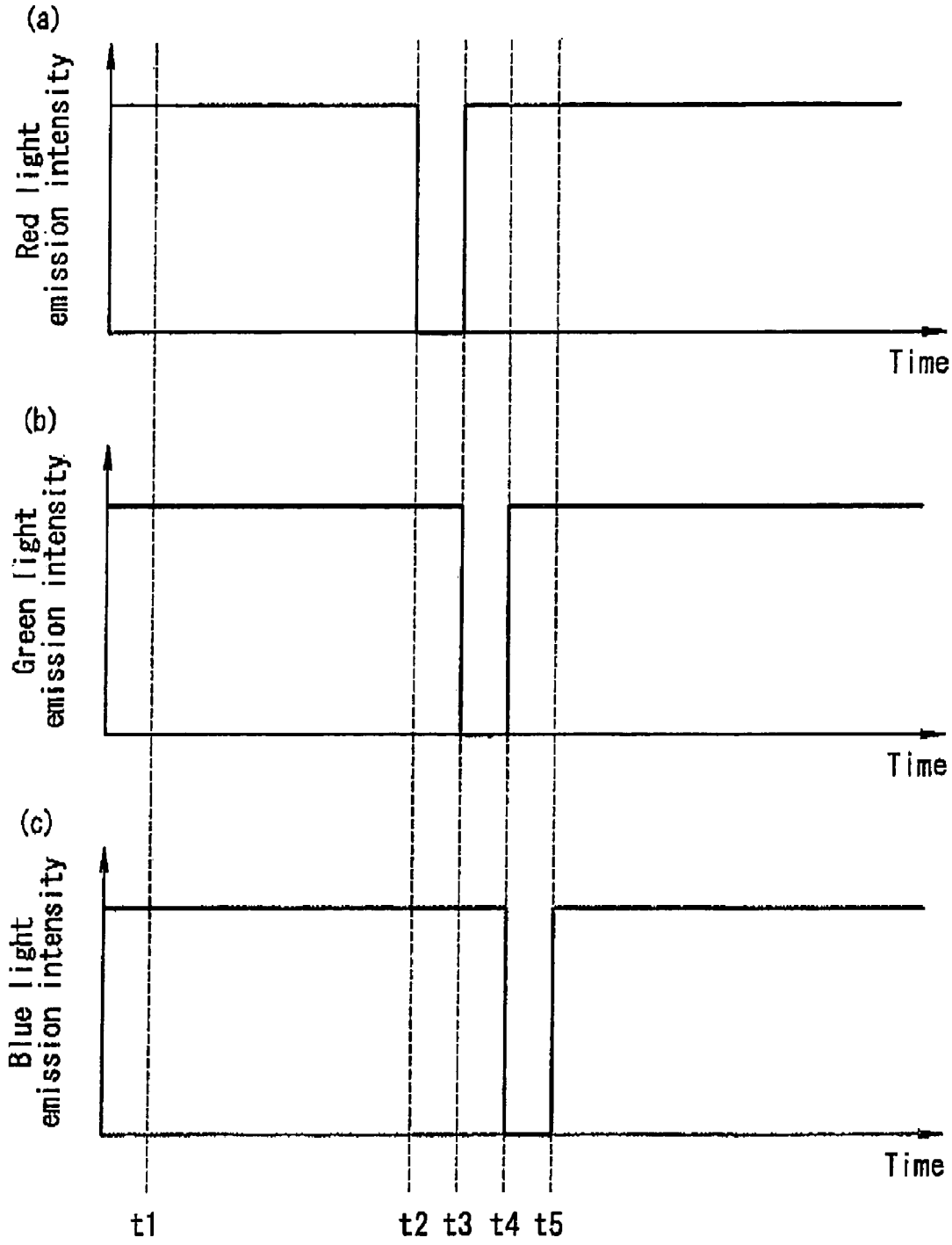
FIG. 4 is a schematic diagram showing a second driving example of the light emitting device of FIG. 1 during a monitoring period.

FIG. 4(*a*)-(*c*) shows a monitoring method in which two of the three types of LEDs are turned on in different combinations, in turn, during a monitoring period (in other words, one LED is turned off in turn during a monitoring period), FIG. 4(*a*)-(*c*) respectively indicates the emission intensity of the red LED, the emission intensity of the green LED, and the emission intensity of the blue LED. The vertical axes indicates emission intensity, and the horizontal axes indicates time.

In FIG. 4(*a*)-(*c*), during a period from time t1 to t2, all the red, green and blue LEDs are turned on. Thus, the light emitting device 10A emits white light. Then, a monitoring period starts at time t2. Only the red LED is turned off, and the green and blue LEDs remain in a turned-on state. As a result, light emitting device 10A emits cyan light. After 1/200 second has elapsed from time t2 it becomes time t3, and the red and blue LEDs are turned on, and the green LED is turned off. Thus, the light emitting device 10A emits magenta light. After another 1/200 second has elapsed: it becomes time t4, and the red and green LEDs are turned on, and the blue LED is turned off. Thus, the light emitting device 10A emits yellow light. Then, after another 1/200 second has elapsed it becomes time t5, and the monitoring period ends. Three types of LEDs are all turned on and the light emitting device 10A provides white light.

As described above, in the case shown in FIG. 4(*a*)-(*c*), only one type of LED is turned off in turn during the monitoring period. The intensity of light which enters the eyes during this period is ⅔, the degree of extinction is improved compared to the case shown in FIG. 3. If the emission intensity of the red LED is r, the emission intensity of the green LED is 9, and the emission intensity of the blue LED is b, three values, i.e., g+b, r+b, and r+g, are obtained for every monitoring period. The values r, g and b can be calculated from these values and compared with the reference value. The results are fed back to the LEDs to adjust the emission intensities such that the difference therebetween becomes zero. Thus, the light emitting device 10A can be stable at any white point. As a result, the emission intensity of the LEDs at or before time t2 and the emission intensity at or after time t5 of the LEDs in FIG. 4(*a*)-(*c*) are different in the strictest sense since they are the values before and after the LEDs receives a feedback.

During the monitoring period t2-t5, the intensity of light which enters the eyes is ⅔, However, since the monitoring period is extremely short, for example, 3/200 of a second, extinction of the light emitting device 10A caused by turning off one type of the LED can be recognized to be almost at a level which is not annoying.

In the case shown in FIG. 4, a frequency to monitor the light-emitting property of the LEDs may be, for example, once in ten seconds. In other words, monitoring periods may be set to have about ten second interval. However, in the case where the light-emitting property of any of the LEDs changes greatly, the LEDs should be monitored in shorter intervals. On the contrary, while the light-emitting properties of the LEDs indicate a small change, monitoring may be performed in longer intervals.

In the case shown in FIG. 4, one type of the red, green and blue LEDs may be turned off in any order. Further, it is not necessary that three types of LEDs are turned off one by one in turn. Only one type of LED can be turned off during one monitoring period, and all the LEDs are turned off in turn over three monitoring periods.

For further reducing an influence of extinction caused by turning off the LEDs during the monitoring period from the example described with reference to FIG. 4, monitoring of emission intensities of the LEDs may be performed when an entire display screen becomes dark rather than at a predetermined interval. In usual television broadcasting, this can be implemented by utilizing the fact that a nearly black display state tends to appear during transitions between commercial films. In this case, a monitoring period starts when the luminance signal among the video signals input to the liquid crystal panel 5 has a level near the black level. Emission intensities of one type or two types of LEDs are monitored. Even if one type or two types of LEDs are turned off for monitoring the LED, there is substantially no influence of extinction caused by turning off the LEDs because the liquid crystal panel 5 is displaying a dark screen.

Third Driving Example of First Embodiment

It is also possible to eliminate the influence of extinction caused by turning off the LEDs during a monitoring period in the first and the second driving examples of the first embodiment. This method is effective when there is no image which is nearly black. As described above, in the method of the second driving example of the first embodiment which is described with reference to FIG. 4, two types among three types of LEDs are turned on and emission intensities of cyan, magenta, and yellow light are monitored by the optical sensor 4. Thus, the emission intensity of the light emitting device 10A during a monitoring period is ⅔. In a third driving example of the first embodiment, light-emission control means 11C, which is yet another example of the light-emission control means 11, is set with a threshold value determined from an image signal to display white light. When the level of a luminance signal included in video signals is equal to or lower than the threshold value, a monitoring period for monitoring emission intensities of the LEDs is started and the size of a driving signal of the liquid crystal panel is extended during the monitoring period. Hereinafter, the method is described with-reference to FIG. 5(*a*)-(*d*).

Figure 5:
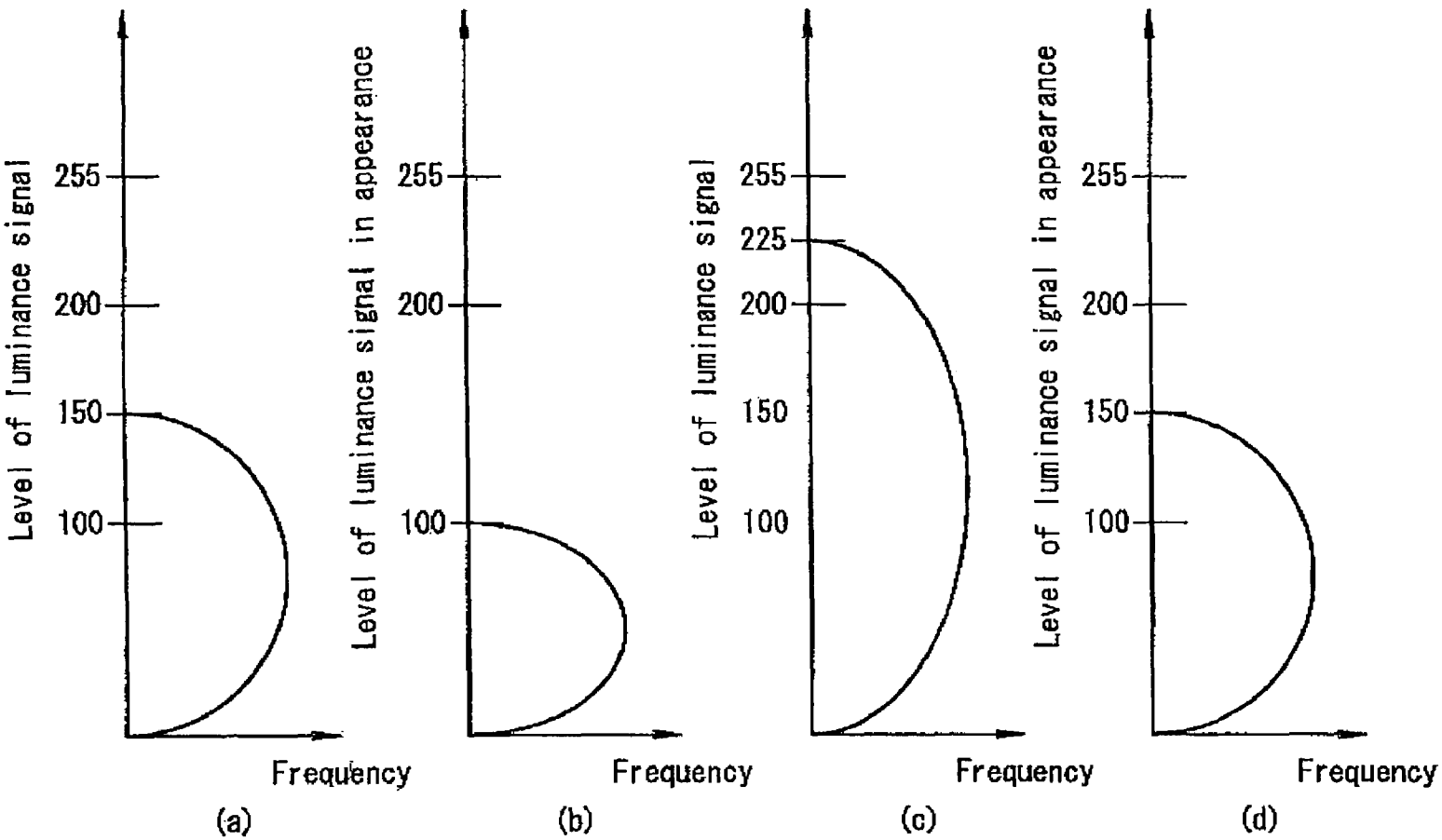
FIG. 5 is a schematic diagram showing a third driving example of the light emitting device of FIG. 1 during a monitoring period.

In FIG. 5, the vertical axes indicate tone levels of the luminance signal and horizontal axes indicate a frequency of generation of the luminance signal. As described above, a value 170, which is ⅔ of the value corresponding to the white level, 255, is set as a threshold value. At a certain point, if it is detected that level 150, which is smaller than the threshold 170, is a maximum level of the luminance signal of a certain image, the level of the luminance signal of the image is distributed between 0 and 150 as shown in FIG. 5(*a*). The monitoring period starts at this point, and one type of LED is turned off for monitoring the emission intensity of the LED; The emission intensity of the light emitting device 10A is about ⅔ since the light is emitted from the other two types of LEDs. Therefore, as shown in FIG. 5(*b*), the level of the luminance signal decreases from 150 to 100 in appearance. In order to avoid extinction of the light emitting device 10A by this, a driving signal of the liquid crystal panel 5 can be extended to cancel a decrease in the emission intensity caused by turning of f a LED during the monitoring period over a period during which one type of the LEDs is turned off.

More specifically, in order to avoid extinction of the light emitting device 10A, the image should be displayed as if the maximum level is 150 over a period in which one type of LED is turned off. Thus, as shown in FIG. 5(*c*), the size of the driving signal of the liquid crystal panel 5 is set to 225, which is a value obtained by multiplying 150 by ⅗. This operation cancels the decrease in the emission intensity of the light emitting device 10A to ⅔, by multiplying the size of the driving signal of the liquid crystal panel 5 by ⅗. The brightness of the light emitting device 10A as a result does not experience any change as shown in FIG. 5(*c*). By compensating the extinction of the light emitting device 10A by extending the size of the driving signal of the liquid crystal panel 5, the influence of the liquid crystal panel 5 can be eliminated. As a result of the actual experimentation there is no change observed in appearance.

In the above description, one type of LED is turned on. The similar effect can be obtained in the case when intensities of red, green, and blue light are monitored while two types of LEDs are turned of f at the same time. However, in this case, the emission-intensity of the light emitting 10 device 10A is about ⅓. Thus, in the third driving example shown in FIG. 5, the threshold valid for determining a time to start the monitoring period is 85, which corresponds to ⅓ of the white level value, 255. In order to eliminate such extinction, the size of the driving signal of the liquid crystal panel 5 should be extended by three times.

In practice, there may be a case where white light is displayed with the luminance signal having the level of 235 or higher. Thus, the threshold values for determining 20 the time to start a monitoring period has to be determined with a coefficient of gamma correction, or extinction due to taking the turning off of the LEDs into consideration.

First Monitoring Method of Second Embodiment

In the first monitoring method of the second embodiment, light emitting and turning, off operations which sequentially shift light-emitting timing of multiple types of tight source during a monitoring period is performed by, the red, green and blue LEDs. In this case, the emission intensities of the light sources are made to zero during a turning off operation.

Figure 6:
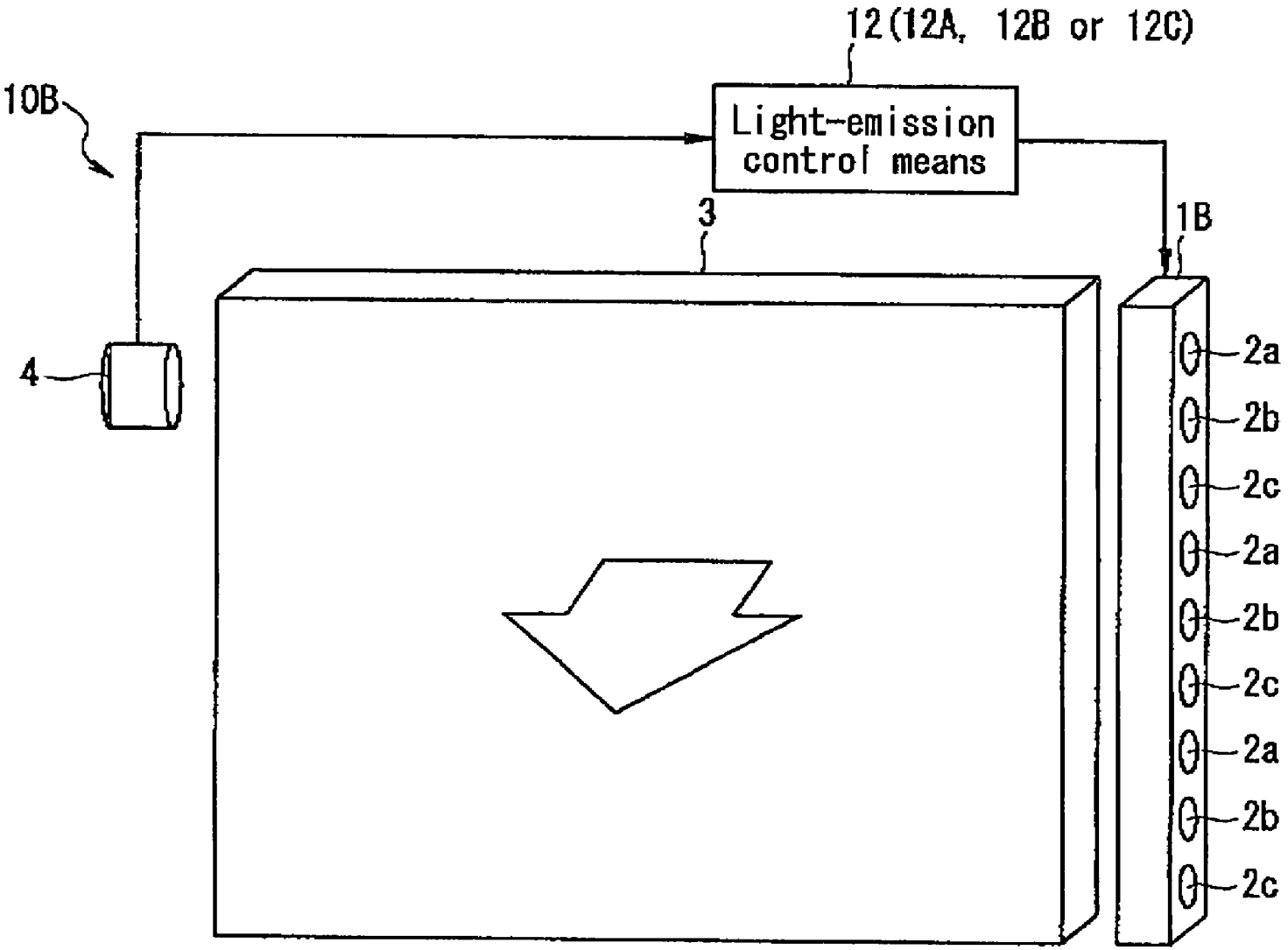
FIG. 6 is a diagram schematically showing a second embodiment of a light emitting device according to the present invention.

With reference to FIG. 6, the second embodiment of the light emitting device according to the present invention will be described. In the figure, a light-emitting device 10B includes: a light source unit 1B provided with at least one (in the figure, three) light-emitting source, which is a set of a plurality of light sources 2*a*, 2*b*, and 2*c*; a light guide plate 3 for uniformly irradiating a plane with light from the light source unit 1B; an optical sensor 4 as a light detection means for monitoring the intensity of light transmitted through the light guide plate 3; and a light emission control means 12 which receives emission intensity information of the light sources obtained by performing light emission control of the three types of the light sources for monitoring during al monitoring period as monitoring results from the optical sensor 4, and performs light emission control of the three types of the light sources so as to have a predetermined emission intensity based on the emission intensity information. The optical sensor 4 may also be located on an upper portion or a lower portion of the light guide plate 3, or at an appropriate position near the light source unit 13, not only at the position opposing the light source unit 1B with respect to the light guide plate 3 as shown FIG. 6. In the figure, for facilitating understanding, the components are illustrated to be separate from each other. The differences in the size of the components are emphasized for facilitating understanding, and the actual sizes of the components are different to that illustrated. Further, only the minimum components required for understanding the present invention are illustrated. For example, a light mixing part may be provided between the light source unit 1B and the light guide plate 3 for reducing unevenness of light from the light source 2*a*-2*c*.

In the second embodiment shown in FIG. 6, LEDs of red, green and blue, i.e., the three primary colors of light, are used as a plurality of light sources in the light-emitting source. The light emitted from the LEDs are mixed with each other and become generally white light. The light passes the light guide plate 3 and emits in a direction indicated by the arrow shown In FIG. 6. Thus, the light emitting device 10B is formed. A liquid crystal panel (not shown) is located such that it receives the light emitted from the light guide plate 3 to form a liquid crystal display apparatus. Further, the direction to emit light indicated by the arrow in FIG. 6 can be controlled by a surface structure of the light guide plate 3.

It is desirable to provide a reflection plate such as an aluminum mirror on a side surface of the light guide plate 3 in order to effectively emit light from the light guide plate 3 to the exterior. The light from the light source unit 1 must reach the optical sensor 4 via the light guide plate 3. Thus, it is necessary that the reflection plate is not provided on a portion of the light guide plate 3 to which the optical sensor 4 opposes, or a reflecting part which slightly passes light is provided on that portion.

Figure 7:
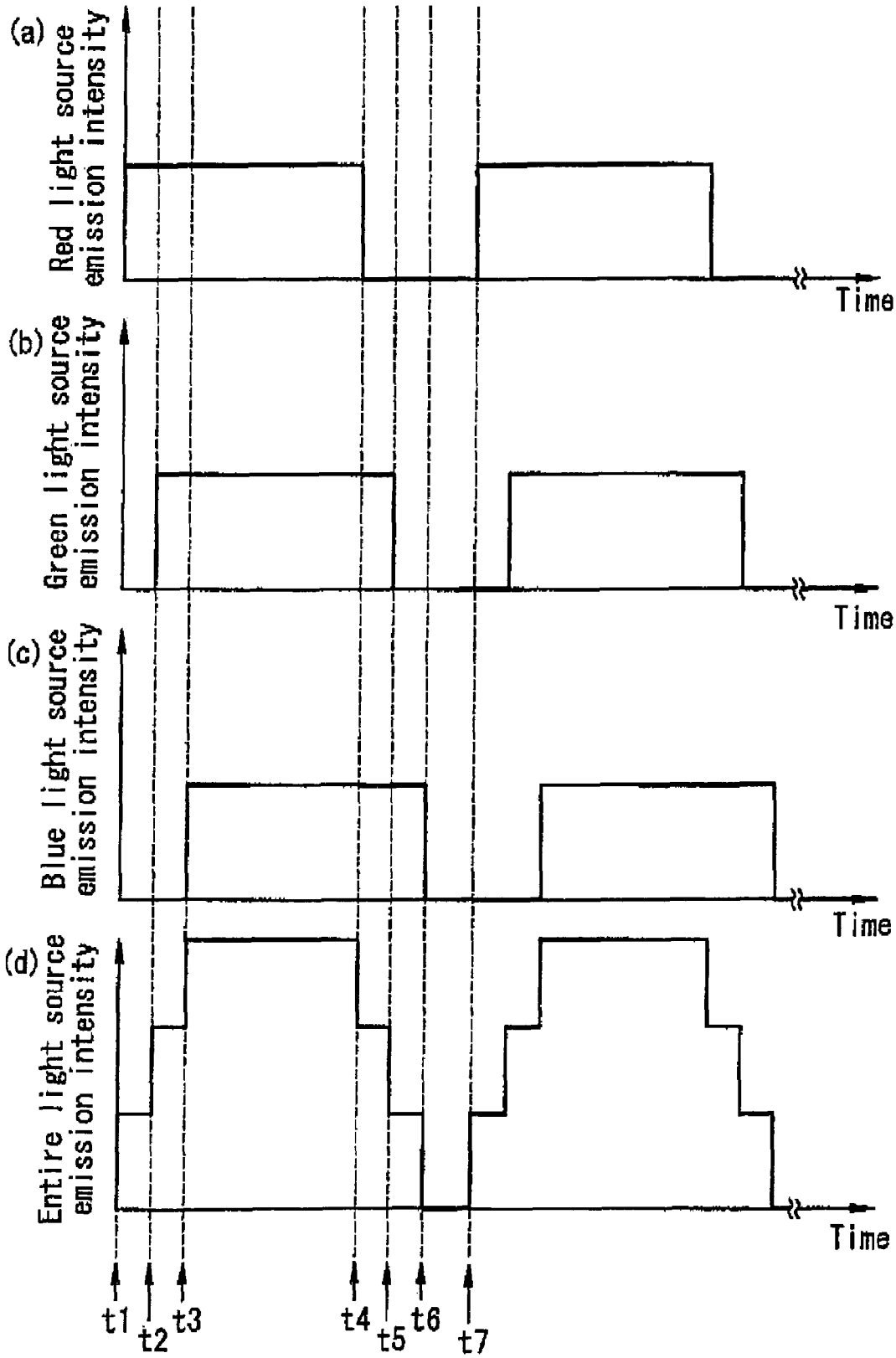
FIG. 7(*a*)-(*c*) is a diagram showing light emitting operations of light sources in a first monitoring method for monitoring the light emitting device of FIG. 6.

FIGS. 7(*a*), (*b*), (*c*) and (*d*) shows the first monitoring method for monitoring an operation of a light source when pulse-width control of light emitted from the red, green, and blue light sources in one light-emitting source of the light source unit 1B of FIG. 6 is performed. In the figure, horizontal axes indicate time, and vertical axes indicate current values (or emission intensities). Herein, light emission control means 12A, which is an example of the light emission control means 12, perform the pulse width control of the light sources. Thus, for example, the red light source emits light from time t1 to t4 as shown in FIG. 7(*a*), the green light source emits light from time t2 to t5 as shown in FIG. 7(*b*), and the blue light source emits light from time t3 to t6 as shown in FIG. 7(*c*). As a result, the emission intensity as a whole light-emitting source changes in a step-wise manner over time as shown in FIG. 7(*d*). Specifically, during the period from time t1 to t2, the emission intensity is that of only the red light source. During the period from time t2 to t3, the emission intensity is that caused by the simultaneous operation of the red light source and the green light source. During the period from time t3 to t4, the emission intensity is that caused by the simultaneous operation of the red light source, green light source, and blue light source, i.e., the emission intensity of the entire light-emitting source.

Light-emitting operations of, the light sources are controlled by a pulse driving circuit, Thus, it is already known which of the light sources is emitting light during a certain period of time. Therefore, when a change in the light sources is monitored in an interval of short amount of time by the optical sensor 4, the emission intensities in appearance of the light sources can be obtained un-ambiguously. Specifically, the emission intensity during the period from time t1 to t2 is that of the red-light source. Thus, if the emission intensity of the period from time t1 to t2 is subtracted from the emission intensity in the period from time t2 to t3, the emission intensity of the green light source can be obtained. Similarly, if the emission intensity from time t2 to t3 is subtracted from the emission intensity of the period from time t3 to t4, the emission intensity of the blue light source can be obtained. This is because the apparent emission intensity is obtained through integral of the emission intensity to time. Based on the emission intensity obtained in this way, an emission intensity which is stable in appearance can be obtained by appropriately adjusting the emission intensities and light-emitting times of the light sources even when the emission intensities of the, light sources change due to a temperature change or a change over time.

Adjusting the emission intensities and light-emitting time of the light sources may be implemented by, for example, making a deviation obtained by comparing the output of the optical sensor 4 and the predetermined set value zero, i.e., controlling the light emitting operations of the light sources so as to match the set value. Matching to the set value may be performed by, for example, the algorithm described below. As described above, the emission intensities in appearance of the light sources correspond to the emission intensities of the light sources integrated by light-emitting time. Actually, the light-emitting time is extremely short. Thus, it is possible to regard that the emission intensity does not change during this period. Therefore, the apparent emission intensity can be obtained as a product of the light-emission intensity and the light emitting time. An output from the optical sensor 4 and the predefined set value are compared to obtain the difference between them. When the obtained difference has a positive value, the emission intensity in appearance is strong. Thus, the light-emitting time of the light source is controlled to be shorter. On the other hand, when the obtained difference has a negative value, the emission intensity in appearance is weak. Thus, the light-emitting time is controlled to be longer. Such a control is performed in a subsequent few cycles to adjust the light-emitting time such that the difference between the emission intensity and the set value become zero for each of the light sources. By matching the respective emission intensities of the light sources to the set value, it becomes possible to control luminance and chromaticity.

An algorithm for matching the emission intensity to the set value is not limited to the above example. Instead, a ratio of the output of the optical sensor 4 and the set value may be taken to control the emission intensity. It is also possible to store the light-emitting time determined as a result of a luminance adjustment and/or chromaticity adjustment by the user and to perform control using the stored light-emitting time as the set value to stably maintain the luminance and/or chromaticity adjusted by the user.

In the second embodiment for monitoring the emission intensities, as shown in FIG. 6, fewer optical sensor(s) 4 fewer than the number of light sources, for example, one optical sensor in the case of FIG. 6, is used by sequentially shifting the timing for the respective light sources to emit light in order to allow the red, green and blue light sources to perform light-emitting operations In the first monitoring method shown in FIG. 7 by the light emission control means 12A. In this case, the monitoring time during which the light sources are turned on and off in turn (for example, a period from time t1 to t3 in FIG. 6) is extremely short and cannot be detected by the eye. A frequency to perform such monitoring is arbitrary, but it is desirable to perform frequently when a change in the emission intensity is large, such as, when power is turned on.

The order to monitor a plurality of light sources during one monitoring period is arbitrary, and not limited to the above-mentioned order of red, green, and blue. Further, it is not necessary to monitor the emission intensities of all the light sources with in one monitoring period. The light sources fewer than all the light sources may be monitored in one monitoring period, and the emission intensities of multiple types of light sources may be calculated after a plurality of monitoring periods.

For example, when an LED driver of a switching method (DC/DC converter or chopper) is used, as the light-emitting control means 12, there is more noise than in the case of a LED driver utilizing a current limiting resistance or a constant current load (series regulator). Thus, a color having longer light-emitting time (color with a large PWM wave duty) may be turned on by priority. In this way, it is possible to enter the next measuring cycle after a long time has elapsed after the light sources are turned off and the noise of the power supply line becomes steady.

It is not necessary that monitoring of the emission intensities of the light sources be performed by shifting the timings for the light-sources to emit light. Instead, as indicated in FIG. 7(*d*) as time t4, t5, and t6, timing to turn off the light sources may be slightly shifted to perform the monitoring. This is possible because the period for the light sources to emit light can be previously set and is also determined by the result of monitoring by the optical sensor 4, and thus, the timing to turn off the light sources can be shifted. This, small shift is utilized to monitor the emission intensities.

The amount of light may be further monitored in the state where all the light sources are-turned off (a period from t6 to t7 when the light source emits light in FIG. 7). This allows a more accurate control when the sensor value does not become zero due to an influence such as outside light by using this value (monitored result) as a background and calculating the emission intensities from a difference between this value and the measured values. Further, not only the influence of the outside light but also the influence of a dark current (the current generated even when the amount of received light is originally zero) can be suppressed.

In the second embodiment shown in FIG. 6, the light source unit 1B is located on a side surface of the light guide plate 3. However, the location or the shape of the light source unit 1B is not limited to this. For example, the light source unit 1B may be located on a back surface of the light guide plate 3, and light can be expanded and projected therefrom. Further, in the first embodiment, the light sources of the three primary colors, red, green and blue are combined to produce composite white light. However, the light sources of two colors, blue and yellow can be used to form a light source unit 1B to monitor emission intensities of the two light sources. Moreover, the optical sensor 4 may be located at any position as described above. However, a plurality of optical sensors of the same type may be provided. Even though a plurality of the optical sensors are provided, it is advantageous in view of cost because they are of the same type, and it also becomes possible to monitor variances in luminance and/or chromaticity by using a plurality of optical sensors.

Second Monitoring Method of Second Embodiment

In the second embodiment, the red, green, and blue light sources perform light-emitting operations and turning off operations to sequentially shift the timing to emit light during monitoring. Particularly, in the second monitoring method, the emission intensities of the light sources are not zero but have predetermined emission intensities during the turning off operation. In this case, light emission control means 12B, which is another example of the light emission control means 12, performs switching control between the first emission intensity and the second emission intensity which is lower than the first emission intensity.

Figure 8:
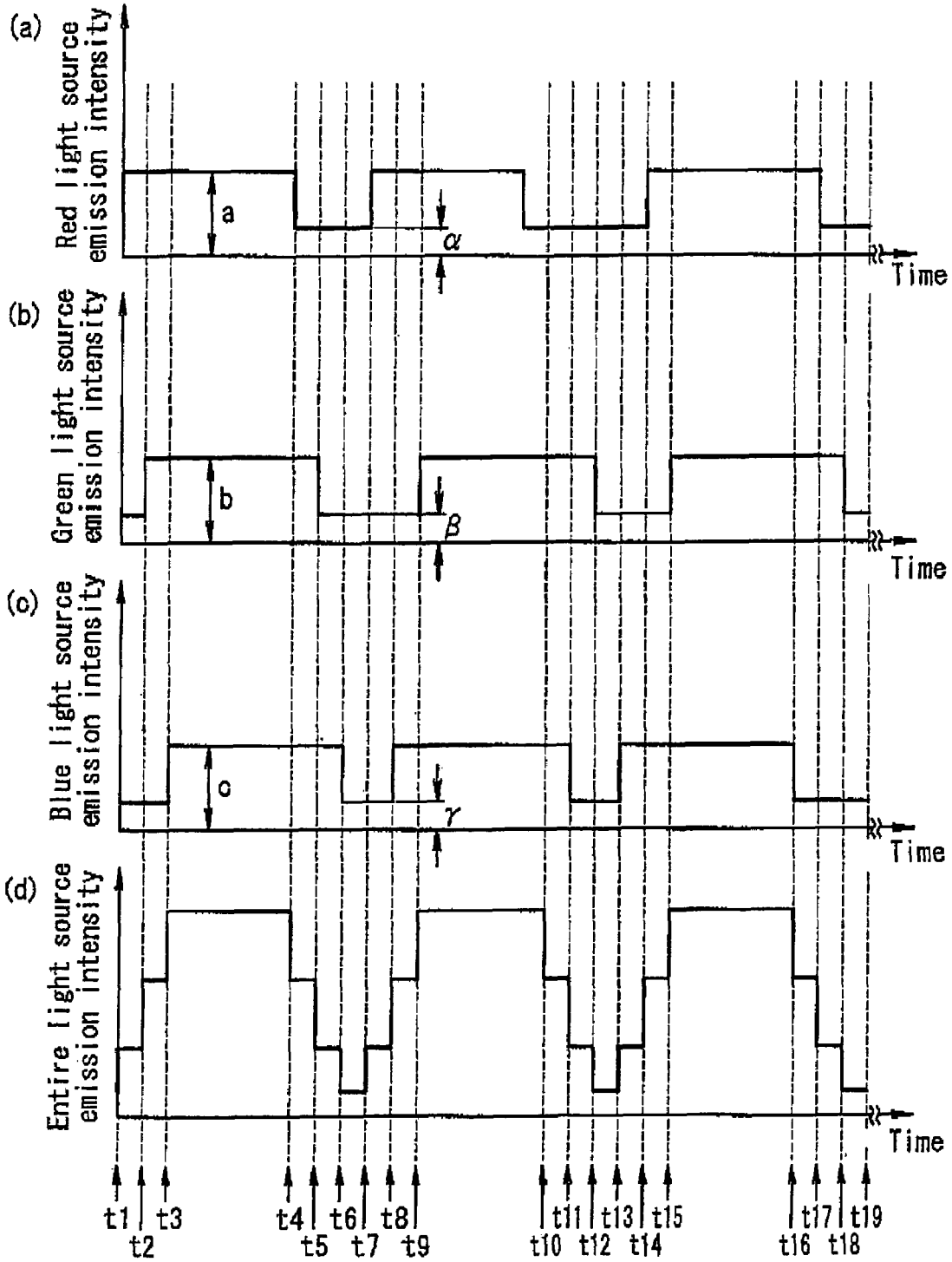
FIG. 8(*a*)-(*c*) is a diagram showing light emitting operations of light sources in a second monitoring method for monitoring the light emitting device of FIG. 6.

Specifically, in the description with respect to the first to third driving examples of the first embodiment and the first monitoring method of the second embodiment, the emission intensities of the light sources are made to be zero in turn during the monitoring period for monitoring the light emission intensities. However, the emission intensities are not necessarily zero. This is particularly effective for a light source which has persistence, such as an LED using a phosphor and a cold cathode fluorescent tube. FIGS. 8(*a*), (*b*), (*c*) and (*a*) is a diagram illustrating the second monitoring method for monitoring the emission intensities of the light sources of which the emission intensities do not become zero when they are turned off. The horizontal axes indicate time and the vertical axes indicate emission intensity of the light sources.

The light emitting operations of the light sources are as follow. As shown in FIG. 8(*a*), the red light source starts to emit light at intensity a at time t1 and attenuates light to intensity a at time t4 during the first cycle, starts to emit light at intensity a at time t7 and attenuates light to intensity a cat time t10 during the second cycle, and starts to emit light at intensity a at time t14 and attenuates light to intensity a at time tl7 during the third cycle.

Similarly, as shown in FIG. 8(*b*), the green light source starts to emit light at intensity b at time t2 and attenuates light to intensity β at time t5 during the first cycle, starts to emit light at intensity b at time t9 and attenuates light to intensity β at time t12 during the second cycle, and starts to emit light at intensity b at time t15 and attenuates light to intensity β at time t1 during the third cycle.

As shown In FIG. 8(*c*), the blue light source similarly starts to emit light at intensity c at time t3 and attenuates light to intensity γ at time t6 during the first cycle, starts to emit light at intensity c at time t8 and attenuates light to intensity γ at time t11 during the second cycle, and starts to emit light at intensity c at time t13 and attenuates light to intensity γ at time t16 during the third cycle.

Since the red, green and blue light sources emit and attenuate light as described above, the emission intensity of the light emitting source formed of such light sources experiences a change as shown in FIG. 8(*d*), which Includes increases and decreases in a step-wise manner. Herein, the period during which the emission intensity increases in a step-wise manner is a monitoring period. Intervals within the monitoring period which have different emission intensities are referred to as the first step, the second step, and the third step in ascending order of their emission intensities. For example, in FIG. 8(*d*): in the first cycle, the interval from time t1 to t2 is the first step, the interval from time t2 to t3 is the second step, and the interval from time t3 to t4 is the third step; in the second cycle, the interval from time t7 to t8 is the first step, the interval from time t8 to t9 is the second step, and the interval from time t9 to t10 is the third step: and in the third cycle, the interval from time t13 to t14 is the first step, the interval from time t14 to t15 is the second step, and the interval from time t15 to t16 is the third step. The following table, Table 1, shows the values of the emission intensities in the first to the third steps in the first to the third cycles.

TABLE 1

| | First cycle | Second cycle | Third cycle |
|---|---|---|---|
| First step | a + β + γ | a + β + γ | α + β + c |
| Second step | a + b + γ | a + β + c | a + β + c |
| Third step | a + b + c | a + b + c | a + b + c |

Table 1 contains six variables, a, b, c, α, β and γ. The six variables can be obtained by using six values in total, for example, three values of the first to third steps in the first cycle, two values of the first and second steps in the second cycle, and one value of the first step of the third cycle. The emission intensities of the light sources when the light is emitted or attenuated obtained as such are used to adjust the luminance and/or chromaticity.

In the monitoring method described with reference to FIG. 8(*a*) to (*a*), the light sources emit light at different emission intensities in each of the first to third cycles. These three cycles are combined into one big cycle for obtaining the emission intensities of the light sources. Such a method is different on the point that monitoring is completed with one cycle including a plurality of monitoring periods from the monitoring method which has been already described with reference to FIG. 7, in which monitoring is completed within one monitoring period consisting of three sequential intervals of a short period of time. This difference is merely a difference in setting points to start and finish monitoring, and there is no substantial difference in the effect of controlling the emission intensities.

In the monitoring method of FIG. 8, the red, green, and blue light sources can emit light in an arbitrary order and at arbitrary timing. As long as the timings to become emission intensities. a, b, and c do not overlap, the order may not necessarily be the one as shown in FIG. 8.

Third Monitoring Method of Second Embodiment

Figure 9:
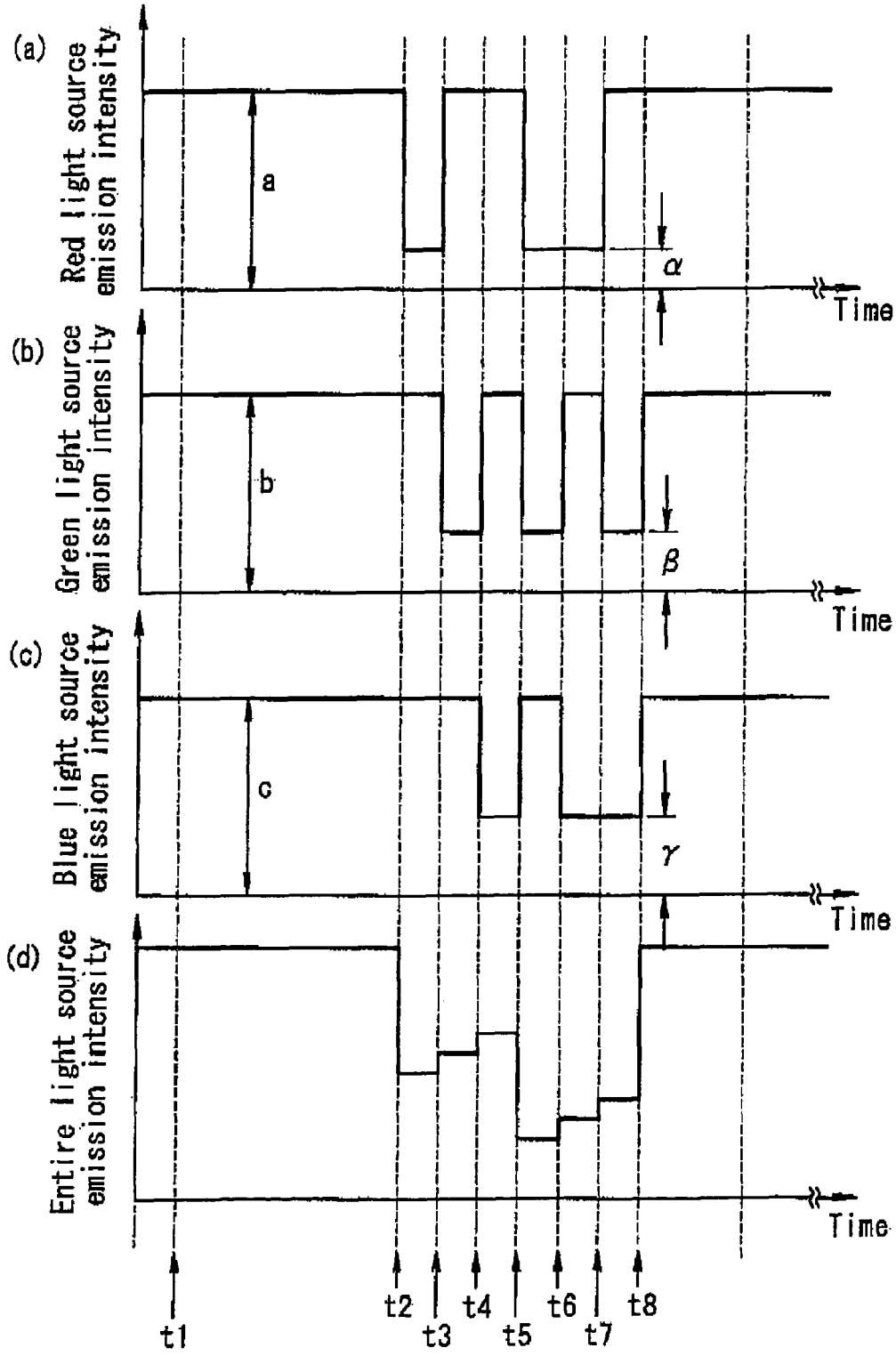
FIG. 9(*a*)-(*c*) is a diagram showing light emitting operations of light sources in a third monitoring method for monitoring the light emitting device of FIG. 6.

Multiple types of light sources in the light emitting device shown in FIG. 6 are controlled by pulse width control as shown in FIG. 7 (first monitoring method) or FIG. 8 (second monitoring method). In the third monitoring method, light emission control means 12C, which is further another example of the light emission control means 12, may drive the multiple types of the light sources by current value control. In this case, the light sources independently attenuate light for a very short time period for monitoring the emission intensities of the light sources. The light-emitting operations of the light sources in such a case is shown in FIGS. 9(*a*), (*b*), (*a*) and (*d*). The horizontal axes indicate time, and the vertical axes indicate emission intensity (current values) of the light sources.

Specifically, as shown in FIG. 9(*a*), the red light source, normally emits light at intensity a from time t1 to t2, emits attenuated light at intensity a from time t2 to t3, again emits light at intensity a from time t3 to t5, emits light at intensity a from time t5 to t7, and emits light at intensity a at time t7 and after.

Similarly, as shown in FIG. 9(*b*), the green light source normally emits light at intensity b from time t1 to t3, emits attenuated light at intensity β from time t3 to t4, emits light at intensity b from time t4 to t5, emits light at intensity β from time t5 to t6, emits light at intensity b from time t6 to t7, emits attenuated light at intensity β from time t7 to t8, and emits light at intensity b at time t8 and after.

As shown in FIG. 9(*c*), the blue light source normally emits light at intensity G from time t1 to t4, emits attenuated light at intensity γ from time t4 to t5, again emits light at intensity c from time t5 to t6, emits attenuated light at intensity γ from time t6 to t8, and emits light at intensity c at time t8 and after.

The emission intensity of the entire light-emitting source in the above-described operation varies as shown in Table 2 below from time t1 to t8 as indicated in FIG. 9(*d*).

TABLE 2

| Time | Emission intensity |
|---|---|
| From t1 to t2 | a + b + c |
| From t2 to t3 | α + b + c |
| From t3 to t4 | a + β + c |
| From t4 to t5 | a + b + γ |
| From t5 to t6 | α + β + c |
| From t6 to t7 | α + b + γ |
| From t7 to t8 | a + β + γ |

Among the emission intensities shown in Table 2, by solving simultaneous equations for six values from time t2 to t8, values or the six variables a, b, c, α, β and γ can be obtained. By obtaining emission intensities of the optical sources, adjustment of white point and/or luminance can be performed as described above with reference to FIGS. 7 and 8. However, for controlling the emission intensity by controlling the current values, it is not necessary to take the integral of the emission with respect to the light-emitting time. As described above, the apparent emission intensity indicates the emission intensity.

In the monitoring method as shown in FIG. 9, the light sources can emit light in any order as long as there is a period when one light source attenuates light and a period when the other two light sources attenuate light. For example, in the case where three types of light sources are used as shown in FIG. 9, as long as there are six types of extinction states, their order and timing can be arbitrary. With reference to FIG. 9, it is described that the light sources attenuate lights in a period from time t2 to t8. However, the light sources may be controlled to increase the intensities of light.

In the case where values for three variables, α, β and γ are zero, in other words, three light sources are turned off, there are three variables, a, b and c. Thus, it is sufficient if three different states are provided during one monitoring period. This is as described above with reference to FIGS. 3 and 4.

Third Embodiment

Figure 10:
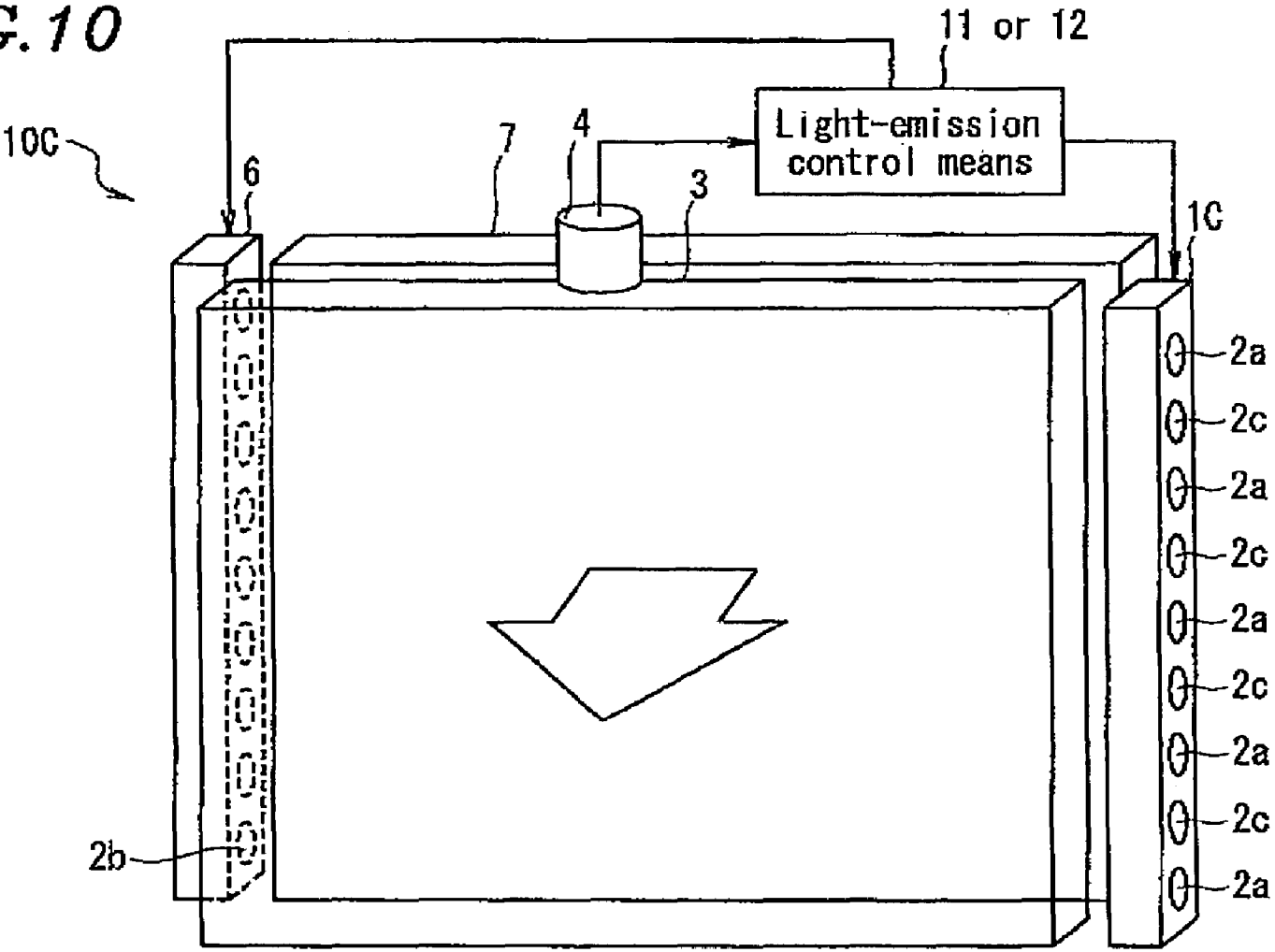
FIG. 10 is a diagram schematically showing a third embodiment of a light emitting device according to the present invention.

FIG. 10 schematically shows a light emitting device 10C of the third embodiment according to the present invention. In the third embodiment, the light emitting device 10C includes: a light source unit 1C provided with a plurality of light-emitting sources, comprising two types of light sources 2*a* and 2*c*; a light guide plate 3 for uniformly irradiating a plane with light from the light source unit 1C; a second light source unit 6 including a light source 2*b* of a type different from the above light sources; a light guide plate 7 for uniformly irradiating a plane with light from the second light source unit 6; an optical sensor 4 as a light detection means; and light emission control means 11 or 12 which receives emission intensity information of the light sources obtained by performing light emission control of the three types of the light sources for monitoring during a monitoring period as monitoring results from the optical sensor 4, and performs light emission control of the three types of the light sources so as to have a predetermined emission intensity based on the emission intensity information. The optical sensor 4 for monitoring intensity of light transmitted through two light guide plates 3 and 7: is provided on the center of the two light guide plates 3 and 7 upper portions such that the optical sensor 4 bridges over the light guide plates 3 and 7. Thus, the optical sensor 4 receives light equally from two light guide plates 3 and 7.

In the third embodiment, the components are separately illustrated and the sizes of the components are different from the actual sizes. Further, it should be noted that FIG. 10 shows only the minimum components required for description. For example, a light mixing part may be provided between the first light source unit 1C and the light guide plate 3 and/or between the second light source unit 6 and the light guide plate 7 in order to reduce the color unevenness of light from multiple types of light sources 2*a*, 2*b* and 2*c*.

One optical sensor 4 is provided as described above, for the sake of reducing cost. If there is no problem in terms of cost, one optical sensor can be provided for each of the light guide plates 3 and 7. In the case of providing one optical sensor 4, it is not necessary that the optical sensor 4 is provided in the center of the upper portions of the light guide plates 3 and 7. The optical sensor 4 may lean to either the light guide plate 3 or 7. Further, the optical sensor 4 may be provided on lower portions instead of upper portions as shown in FIG. 10. In short, the optical sensor 4 may be fixed to any position as long as such a state can be defined as an initial state and the emission intensities of the light sources can be adjusted.

In the light-emitting device 10C of FIG. 10, for example, the light source 2*a* is a red LED, the light source 2*b* is a green LED, and the light source 2*c* is a blue LED. In the first light source unit 1C, red and blue LEDs are provided, and, in the second light source unit 6, green LEDs are provided. Light emitted from the LEDs passes the light guide plates 3 and 7, and emits in a direction indicated by the arrow in the figure. Use of two light guide plates as described above allows the light sources to be located on both sides, and thus it is effective in enhancing the intensities of light.

It is also possible to locate light-emitting sources comprising red, green and blue LEDs on both sides of the light guide plates. However, in view of the emission efficiency of the current state, it is appropriate to provide LEDs such that their ratio in numbers among colors is 1:2:1 for emission adjustment in order to reproduce white light from three colors, red, green and blue. Taking this into account, to locate red and blue LEDs on one side and green LEDs on the other side as shown in FIG. 10 has a big merit. The reason for this is described below.

In the case where the red, green and blue light sources are located on one side of the light guide plate, since the emission intensity detected by the optical sensor is the sum of the light from the light sources on one side of the light guide plate, the sum of the emission intensities for each of the colors can be obtained but the emission intensity of each of the light sources cannot be obtained as it is. Therefore, for individually adjusting the emission intensities of the light sources on one side, any of the monitoring methods described with reference to FIGS. 7-9 should be performed for the light sources on both sides, i.e., should be repeated twice. On the other hand, in the case where the red and blue light sources are provided on one side of the light guide plate and the green light sources are provided on the other side of the light guide plate, the emission intensities of the light sources can be obtained by performing any of the monitoring methods described with reference to FIGS. 7-9 only once. Although the current values flowing through the light sources can be recognized for a certain degree, as it is impossible to precisely grasp the changes including changes of the light source over time, changes in the states due to heat generation, and the like, monitoring method for monitoring the emission intensities of the light sources and the observations feeding back have a technically significant meaning.

A display apparatus is formed by locating a liquid crystal panel in front of the light emitting device 10B or 10C as shown in FIG. 6 or 10. Light having the adjusted emission intensity passes through the liquid crystal panel and displays characters and images. The light-emitting device may be placed behind the liquid crystal panel to be used as a backlight, or may be located in front of the reflective type liquid crystal panel to be used as a front light.

In the case where the light emitting device 10B or 10C is used as a front light of the reflective type liquid crystal panel, if the values of $\alpha$, $\beta$ and $\gamma$ are equal to or greater than the threshold values, it is determined that outside light (ambient light, illuminance of ambient circumstance) is sufficient and the LEDs of the lights sources may be completely turned off. In the case where the light emitting device 10B or 10C is employed in a display of a digital camera, or a mobile phone with a built-in camera, the optical sensor of the present invention may be applied for determining whether to use a strobe light or a flashlight. This is because the optical sensor and peripheral circuits are originally designed with high precision such that they can also be used for photometry, and thus, they can be used as an optical sensor for comparing with the threshold values, such as infrared remote control, obstruction detection, determination of sunset, or the like.

In a studio for recording a TV program, amusement facility or the like, one large display apparatus, which is formed by combining a plurality of relatively small display apparatuses, may be used. For example, if 16 of 30-type displays are arranged into four rows and four columns, one 120-type display can be implemented. In this case an optical sensor may be provided in each of the small display apparatuses. The present invention is effective for absorbing individual differences among the display apparatuses in a so-called multi-monitoring system.

In the liquid crystal display apparatus which has a screen size of 30 or 40, a plurality of small backlight units may be arranged to form one plane light source for simplifying assembly, maintenance, or the like. In such a case, a sensor may be provided for each of the backlight units. Even though heat radiating conditions in the units provided on the lower side and those in the units provided on the upper side do not match due to the influence of the gravitational field of the earth, air convection or the like, the sensors absorbs such differences. Thus, it is not necessary to be careful about thermal design, place of installment; or the like.

Fourth Embodiment

The light emitting device 10A. 10B, and 10C which has been described above can be applied to a read apparatus. In the fourth embodiment, the above-described light emitting device 10A, 10B, or 10C is applied to a read apparatus.

Figure 11:
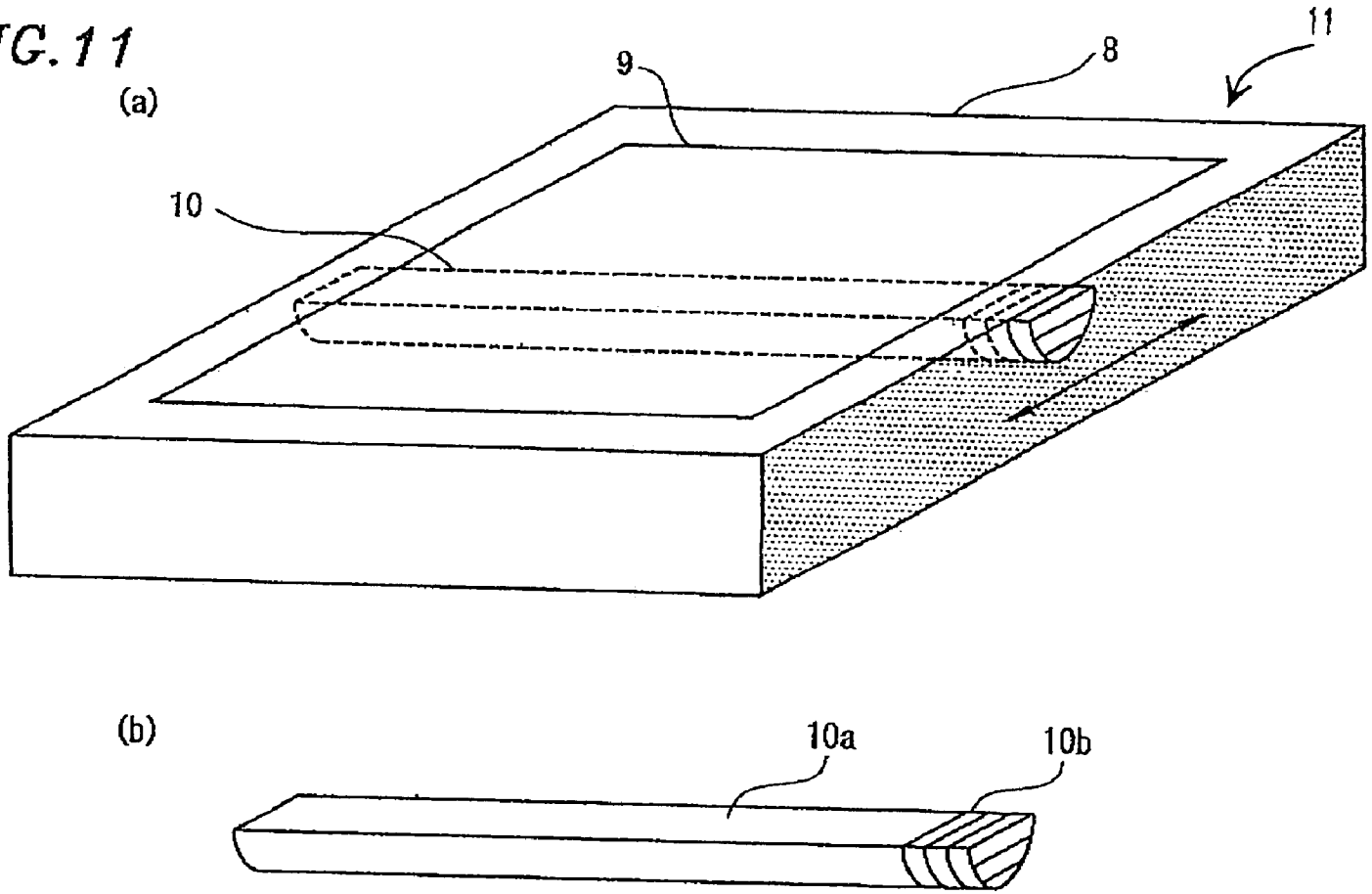
FIG. 11(*a*) is a diagram schematically showing a read apparatus using the light emitting device of a fourth embodiment according to the present invention.
Figure 12:
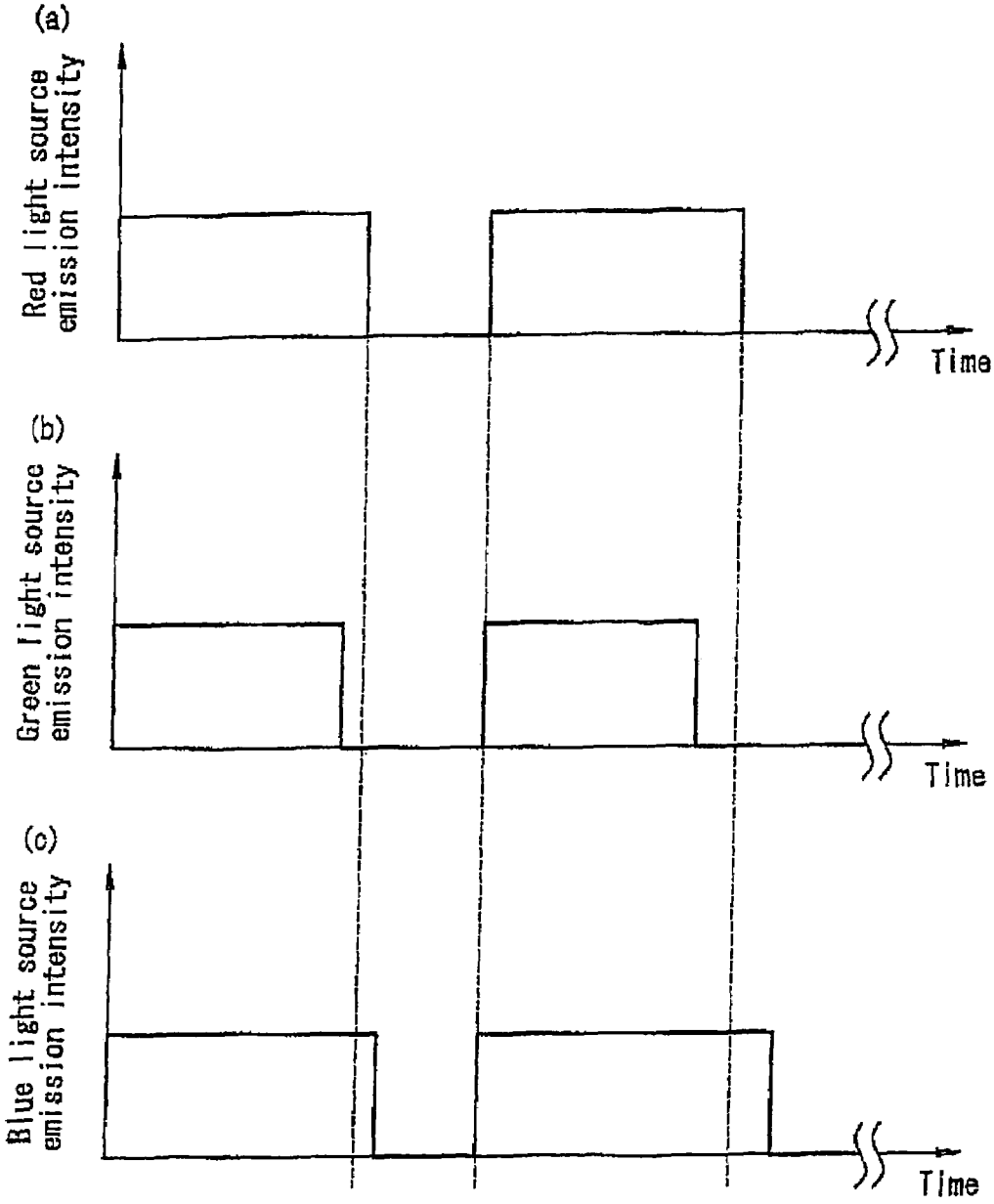
FIG. 12 CONVENTIONAL ART
FIG. 12(*a*)-(*c*) is a diagram illustrating light emitting operations when pulse control of respective light sources is performed in a conventional light emitting device.
Figure 13:
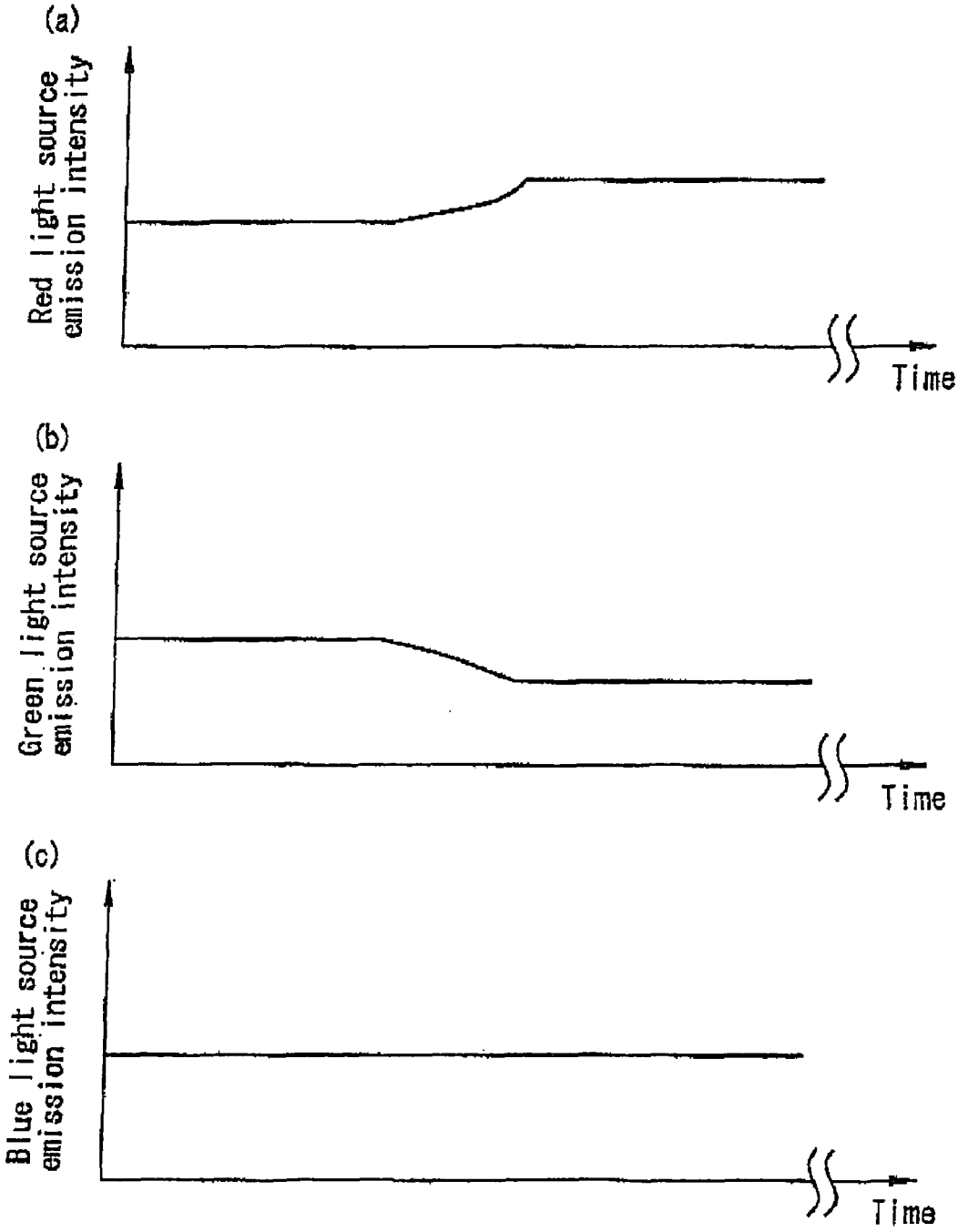
FIG. 13 CONVENTIONAL ART
FIG. 13(*a*)-(*c*) is a diagram illustrating light emitting operations when current control of respective light sources is performed in a conventional light emitting device.

FIG. 11 shows an example; (a) schematically shows a read apparatus, and (b) schematically shows the light emitting device according to the present invention.

As shown in FIG. 11(*a*), the read apparatus 11 includes: a read portion 8 which operates as a scanner, copying machine or the like; a read copy holder 9 as a stage for putting a copy to be read, and a light-emitting device 10 for illuminating the copy.

As shown in FIG. 11(*b*), the light-emitting device 10 is formed of a light emitting portion 10*a* for emitting light so as to uniformly illuminate the copy, and a light source unit 10*b* in which multiple types of light sources are located. The light source unit 10*b* incorporates red, green and blue light sources and an optical sensor (not shown) for monitoring emission intensities of these light sources. When the red, green, and blue LEDs are used as light sources, an illumination with more vivid colors compared to a cold cathode fluorescent tube or white LED can be implemented. A copy placed on the read copy holder 9 is illuminated with light from the light-emitting device 10 having the above-described structure, reflects the light with vivid colors, and is read in the read portion 8. For adjusting the emission intensities of the light sources in the light source unit 10*b*, any of the monitoring methods described with reference to FIGS. 7-9 may be used.

Among the optical sensors, an optical sensor for controlling luminance and chromaticity and a licensor for reading a copy may be of the same type. It may be needless to say that operations must be controlled in a time-divisional manner so that the operations do not conflict.

Currently, a photocell, a photo-multiplier, a photodiode, and the like are known as an optical sensor element so suitable for photometry applications. Hereinafter, the characteristics of these elements will be described.

In a photocell which is sensitive to visible light, CdS (cadmium sulfide) is used. If a photocell is employed, it becomes difficult to use in view of the low degree of environmental load, compared to a CRT (cathode ray tube) using lead glass, or a CCFL (cold cathode fluorescent lamp) using mercury. If an obligation to recycle products using cadmium exists in the future, the cost will rise. There is also a possibility that use of cadmium itself will be banned.

A photo-multiplier has too-large a scale for this application. Not only inexpensive cost, but also in that the ease of maintenance is at a low level.

The other element is a photodiode. This can be divided into several groups depending on the materials. Amorphous silicon photodiodes show spectral sensitivity characteristics similar to the luminosity factor of a human. However, the mobility of a carrier in a semiconductor is small and the response speed is slow Thus, it is difficult to use a photodiode for the purpose of the present invention. On the other hand, a single crystal silicon photodiode does not have a problem of a response speed, but has a defect that it has sensitivity to infrared radiation.

In the present invention, it is sufficient if outputs of red, green, and blue lamps are controlled at constant levels. Thus, generally, there is no problem even if the spectral sensitivity of an optical sensor is somewhat different from the luminosity factor of a human. It is rather preferable that the spectral sensitivity characteristics are flat because an S/N ratio (signal to noise ratio) is higher.

In the case where LEDs are employed for lamps as light sources, the spectral sensitivity characteristics of the optical sensor from red to infrared radiation cannot be ignored. This is because AlGaInP (aluminum gallium indium phosphide) type red LED is more sensitive to temperature change in a junction than green or blue LEDs of GaInN (gallium indium nitride), and has unstable luminance and also emission wavelength. In other words, the emission wavelength becomes longer as the temperature increases. This wavelength shift is so large that it cannot be disregarded in this application.

Figure 14:
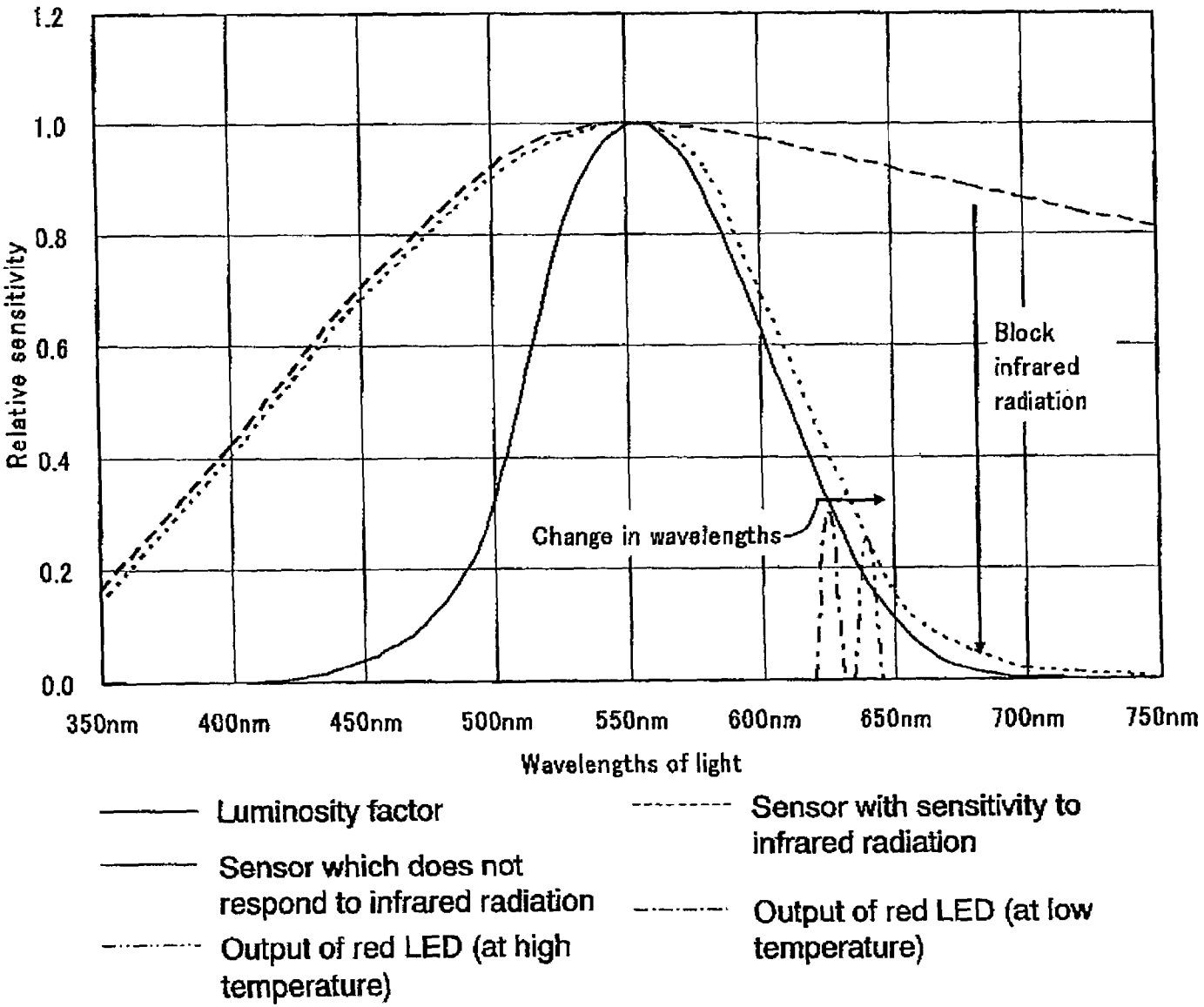
FIG. 14 is a graph indicating luminosity factor characteristics of human, spectral sensitivity characteristics of two types of optical sensors, and light emitting wavelengths and temperature changes of red LEDs.

Even though the temperature at the junction increases, for obtaining an output proportional to the luminance, the spectral sensitivity of the optical sensor has to match the luminosity factor characteristics of a human. Thus, a luminosity factor filter is inserted between a light guide plate and the optical sensor to block the infrared radiation. As shown in FIG. 14, the spectral sensitivity from the red light to the infrared radiation should match the luminosity factor. Thus, even if the emission frequency of the red light changes due to self heat generation, a change in ambient temperature, or the like, the optical sensor can track the change. In other words, even if the wavelength becomes longer, the gain of the sensor can be decreased In proportion to the luminosity factor of a human.

FIG. 14 is a graph depicting a portion of concern for the sake of understanding. Actually, it is sufficient if the spectral sensitivity of the optical sensor approximately matches the luminosity factor of a human, in the vicinity of the emission wavelength of the red LED.

It is also found that an effect of feed back control of the present invention changes due to the spectral sensitivity of the sensor from read light to infrared radiation, and thus, the light emitting device which handles this is added. It is optimum to adjust the spectral sensitivity of the optical sensor to the luminosity factor of a human with the emission wavelength of the AlGaInP type red LED. FIG. 14 is a graph for illustrating this.

There are a variety of luminosity factor filters on the points of price, transmittance of light (sensitivity of the sensor), resistance to environment (temperature under burning or scorching, temperature at soldering for mounting, or the like), and other properties due to degree of precision with which they are produced. It is needless to say that the temperature characteristic of a luminosity factor has to be sufficiently smaller than the temperature characteristic of the LEDs. For a display apparatus used for applications such as a television receiver, word processor, terminal device for e-mail, technical drawing, or the like, it is much more important that stability is high and maintenance is not necessary rather than pursuing high precision.

Figure 15:
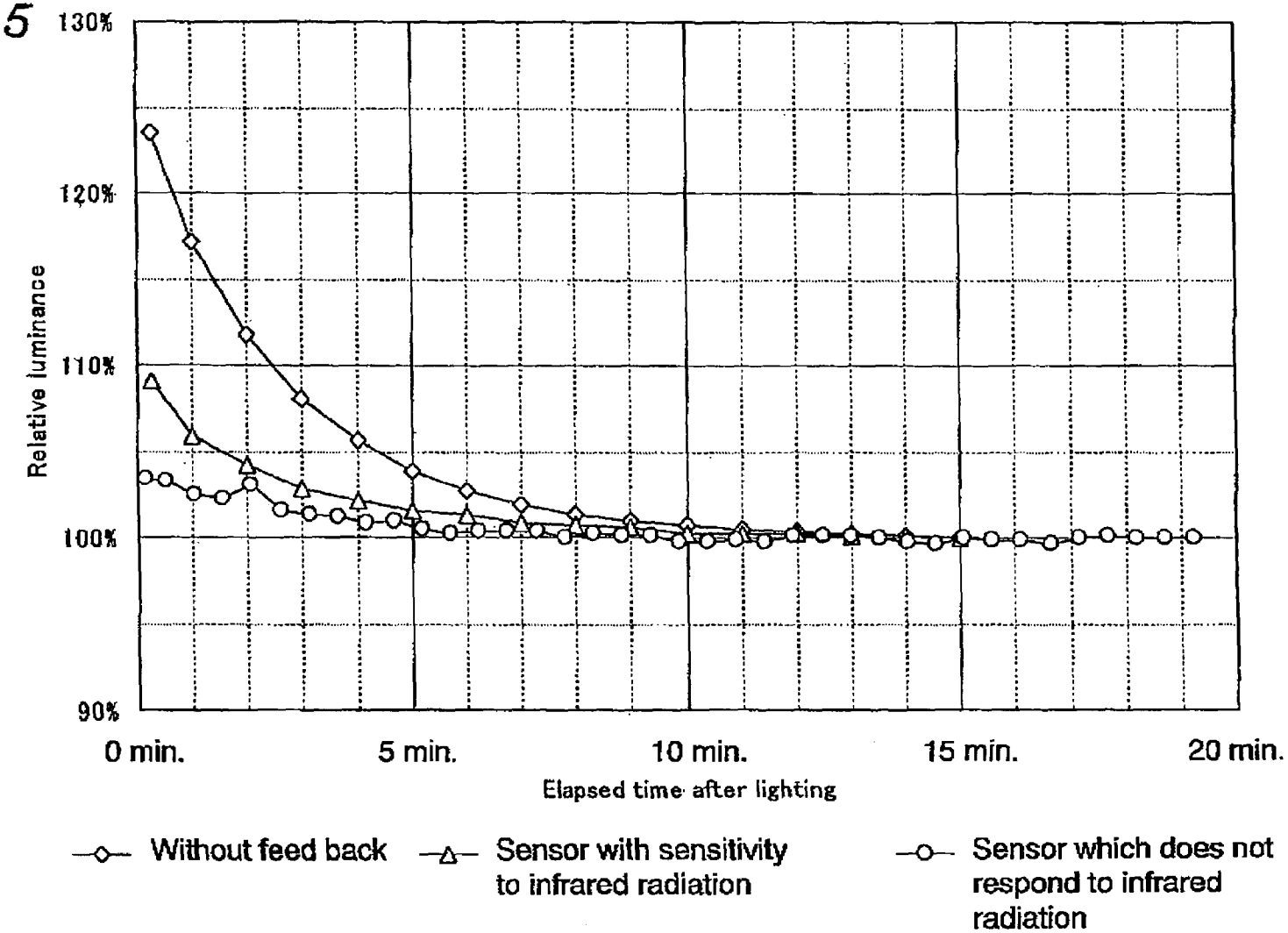
FIG. 15 is a graph of characteristics of a luminosity factor filter of an optical sensor and experimentation results in stability of light emitting luminance.

It is confirmed by experimentation that, if a material is selected with attention to the spectral sensitivity characteristics, the present invention provides sufficient characteristics in practical use. FIG. 15 shows the results actually measured by using two types of sensors.

Without feedback control of the present invention (without feedback), the relative luminance after the backlight is lit increases by about 25%. This can be perceived easily and it is beyond the tolerance limit. In the case where a sensor with sensitivity to infrared radiation, which does not have a luminosity factor filter, is used, a change in luminance is improved to about 10%. In the case where infrared radiation is blocked by the luminosity factor filter, a change in luminance is suppressed to 4%. Accordingly, if the spectral sensitivity of the optical sensor is taken into consideration, the luminance can be stabilized at a speed faster than not only a CRT but also a CCFL. As described above, a specific effect of the feedback control of the present invention (FIG. 15) was confirmed by experimentation.

The fourth embodiment of a light emitting device, and a display apparatus and a read apparatus using the light emitting device as an auxiliary light source has been described above. However, the present invention is not limited to the first through fourth embodiments. Hereinafter, variations of the first through fourth embodiments of the present invention will be listed.

(1) Regarding light source, any light source may be used instead of the LEDs. However, in the present invention, the light sources are turned on and off in short time. Thus, a light source which can-be driven at a fast rate such as an LED is preferable.

(2) The light-emitting device shown in FIGS. 1 and 2 emits white light. Thus, the light source unit 1 includes light sources which emit light of red, green and blue colors. However, the number and the types of the light sources forming the light source unit 1 may be determined depending on which of the colors it is desired to be emitted by the light emitting device. For example, in the light-emitting device for emitting magenta light, red and green light sources are provided in the light source unit, and the LEDs are turned off in turn one type at a time during a monitoring period.

(3) In FIGS. 1 and 2, the optical sensor 4 is located on the light guide plate 3 so as to oppose the light source unit 1. However, the position of the optical sensor 4 is not limited to this, and may be located at any position on the guiding plate 3. Further, the optical sensor 4 may be located on the light source unit 1 or the light mixing part 2.

(4) A time period during which the LEDs are being turned on or off in the monitoring period is not limited to 1/200 second. An appropriate length for the period may be selected in accordance with the types and the number of the light sources.

(5) It is not necessary to feed back the monitoring results by optical sensor 4 to the light sources in every monitoring period. It is also possible to appropriately process the monitoring results over a plurality of subsequent monitoring periods before feeding back to enhance the precision.

(6) The order to drive the multiple types of light sources emitting light of different colors during one monitoring period is arbitrary, and, not limited to the order of red, green, and blue as described above.

(7) It is not necessary to complete monitoring of all the light sources within one monitoring period. Monitoring of one type of light source may be completed in one monitoring period to complete monitoring of all the light sources in a plurality of sequential monitoring periods, (8) The light emitting device means not only an auxiliary light source for a display apparatus or read apparatus but also an illumination light source for irradiating a space.

As can be seen from the description of one embodiment of a display device of the present invention, and a display apparatus using the display device as an auxiliary light source, according to the present invention there is provided a light emitting device comprising multiple types of light source emitting light of different colors, which comprises light emission control means for allowing at least one light source among the multiple light sources to emit light during a predetermined period for monitoring emission intensities at an emission intensity different from that in the period other than the predetermined period. Thus, the following significant effects are provided.

(1) The emission Intensities of the light sources can be monitored with the optical sensor(s) of a number fewer than the types of the optical sources, and a light emitting device without variance can be obtained at low cost.

(2) Since the emission intensities of the at least one light source among multiple types of light sources are controlled using the result monitored during the predetermined period, the light emitting device which can adjust the white point and/or emission intensities can be obtained.

(3) Emission properties of the light sources can be adjusted without causing a substantial influence in appearance during the operating period of the light sources.

(4) A light emitting device using any combination of the light sources can be adjusted suitably at an appropriate time. Thus, the light emitting device can always be operated in a suitable state.

(5) Since the emission intensities of the light sources are controlled by current values or light emitting time, the light emitting device which can readily control the emission intensities can be obtained.

(6) The emission luminance and/or emission chromaticity are controlled to desired values by controlling the emission intensities of the light sources. Thus, the light emitting device providing stable luminance and chromaticity can be obtained.

(7) By using, for example, LEDs as multiple types of the light sources, the light emitting device having high color purity can be obtained.

(8) By using the light emitting device according to the present invention, display apparatus and read apparatus which have controllable white point and/or emission intensity can be obtained.

INDUSTRIAL APPLICABILITY

In the field of a light emitting device including light sources which emit light of multiple colors, display apparatus using the light emitting device, and a read apparatus using the light emitting device, emission intensities of multiple types of the light sources can be monitored with fewer types of the optical sensors, and white point and/or luminance properties can be controlled.

The invention claimed is:

1. A light emitting device comprising:

multiple types of light sources emitting light of different colors;

light detection means for monitoring emission intensity of at least one light source among the multiple types of light sources; and light emission control means which performs control to provide a light emitting period in which all of the multiple types of light sources emit light at a same time at predetermined emission intensities and a monitoring period in which an emission intensity of only a single light source is decreased, wherein the light emission control means controls the emission intensity of the at least one light source among the multiple types of light sources using emission intensity information from the light detection means in the monitoring period to adjust composite light from the multiple types of light sources to have a desired luminance or chromaticity.

2. A light emitting device according to claim 1, wherein the light emission control means provides the monitoring period by shifting one of timing to obtain the predetermined emission intensities and timing to decrease the emission intensity of the single light source with respect to timing to obtain the predetermined emission intensities and timing to decrease the emission intensity of other single light source.

3. A light emitting device according to claim 1, wherein the light emission control means decreases the emission intensities of the at least one of but fewer than the number of the multiple types of light sources in the monitoring period.

4. A light emitting device according to claim 3, wherein the light emission control means provides the monitoring period by shifting one of timing to obtain the predetermined emission intensities and timing to decrease the emission intensities of at least one of but fewer than the number of the multiple types of light sources with respect to timing to turn on or timing to turn off other light sources.

5. A light emitting device comprising:

multiple types of light sources emitting light of different colors;

light detection means for monitoring emission intensity of at least one light source among the multiple types of light sources; and light emission control means which performs control to provide a light emitting period in which all of the multiple types of light sources emit light at a same time at predetermined emission intensities and a monitoring period in which emission intensities of at least one of but fewer than the number of the multiple types of light sources are increased to a value greater than zero and greater than the light-emitting intensity of each of the light sources during a period during which all of the types of light sources are made to emit light at the same time, wherein the light emission control means controls the emission intensity of the at least one light source among the multiple types of light sources using emission intensity information from the light detection means in the monitoring period to adjust composite light from the multiple types of light sources to have a desired luminance or chromaticity.

6. A light emitting device according to claim 5, wherein the light emission control means provides the monitoring period by shifting one of timing to obtain the predetermined emission intensities and timing to increase the emission intensities of at least one of but fewer than the number of the multiple types of light sources with respect to timing to obtain the predetermined emission intensities and timing to increase the emission intensities of other light sources.

7. A light emitting device according to any one of claims 1 to 6, wherein the light detection means has spectral sensitivity characteristics approximately matching luminosity factor characteristics with a light emission wavelength of the at least one of the multiple types of light sources being a center.

8. A light emitting device according to any one of claims 1 to 6, wherein the light detection means includes a luminosity factor filter for blocking infrared radiation.

9. A light emitting device according to any one of claims 1 to 6, wherein the light emission control means provides a period in which all of the multiple types of light sources are turned off, the light detection means monitors amount of light in a state that all of the multiple types of light sources are turned off.

10. A light emitting device according to claim 5, wherein the light emission control means increases the emission intensities of the at least one of but fewer than the number of the multiple types of light sources in the monitoring period.

11. A light emitting device according to claim 10, wherein the light emission control means provides the monitoring period by shifting one of timing to obtain the predetermined emission intensities and timing to increase the emission intensities of at least one of but fewer than the number of the multiple types of light sources with respect to timing to turn on or timing to turn off other light sources.

12. A light emitting device, comprising:

multiple types of light sources emitting light of different colors;

light detection means for monitoring emission intensity of at least one light source among the multiple types of light sources; and light emission control means which performs control to provide a light emitting period in which all of the multiple types of light sources emit light at a same time at predetermined emission intensities and a monitoring period in which at least one of but fewer than the number of the multiple types of light sources emits light at emission intensity different from that in the light emitting period in which all of the multiple types of light sources emit light at the same time, wherein the light emission control means provides a period in which all of the multiple types of light sources are turned off, the light detection means monitors amount of light in a state that all of the multiple types of light sources are turned off, the light emission control means corrects emission intensity information from the light detection means in the monitoring period based on the state that all of the multiple types of light sources are turned off.

13. A light emitting device, comprising:

multiple types of light sources emitting light of different colors;

light detection means for monitoring emission intensity of at least one light source among the multiple types of light sources; and light emission control means which performs control to provide a light emitting period in which all of the multiple types of light sources emit light at a same time at predetermined emission intensities and a monitoring period in which emission intensities of at least one of but fewer than the number of the multiple types of light sources are decreased to a value greater than zero and less than the light-emitting intensity of each of the light sources during a period during which all of the types of light sources are made to emit light at the same time, wherein the light emission control means controls the emission intensity of the at least one light source among the multiple types of light sources using emission intensity information from the light detection means in the monitoring period to adjust composite light from the multiple types of light sources to have a desired luminance or chromaticity.

* * * * *